United States Patent [19]

Oliver et al.

[11] Patent Number: 4,911,770

[45] Date of Patent: Mar. 27, 1990

[54] EXPLOSIVE EMULSIFICATION METHOD

[75] Inventors: Raymond Oliver, Norton-on-Tees; Jeremy G. B. Smit, St-Hilaire; Fortunato Villamagna, Montreal, all of Canada

[73] Assignee: Imperial Chemical Industries PLC, London, England

[21] Appl. No.: 284,893

[22] Filed: Dec. 15, 1988

[30] Foreign Application Priority Data

| | | | |
|---|---|---|---|
| Dec. 17, 1987 | [GB] | United Kingdom | 8729444 |
| Mar. 7, 1988 | [GB] | United Kingdom | 8805352 |
| Jul. 5, 1988 | [GB] | United Kingdom | 8815985 |

[51] Int. Cl.[4] ..... D03D 23/00

[52] U.S. Cl. ..... 149/109.6; 149/2; 149/21; 149/110; 149/112; 149/113; 264/3.4; 264/3.5

[58] Field of Search ..... 149/2, 21, 109.6, 110, 149/112, 113; 264/3.4, 3.5

[56] References Cited

U.S. PATENT DOCUMENTS

| | | | |
|---|---|---|---|
| 3,185,448 | 5/1965 | Fraser et al. | 149/2 |
| 4,472,215 | 9/1984 | Binet et al. | 149/2 |
| 4,491,489 | 1/1985 | Ellis et al. | 149/109.6 |
| 4,510,958 | 4/1985 | Coursen | 149/108.8 |
| 4,676,849 | 6/1987 | Curtin et al. | 149/2 |
| 4,790,891 | 12/1988 | Halliday et al. | 149/2 |

FOREIGN PATENT DOCUMENTS

| | | |
|---|---|---|
| 370299 | 3/1923 | Fed. Rep. of Germany . |
| 581826 | 7/1933 | Fed. Rep. of Germany . |
| 1207345 | 12/1965 | Fed. Rep. of Germany . |
| 2441620 | 6/1980 | France . |
| 331928 | 7/1930 | United Kingdom . |
| 362430 | 12/1931 | United Kingdom . |
| 886575 | 1/1962 | United Kingdom . |
| 1422737 | 1/1976 | United Kingdom . |
| 2036731 | 7/1980 | United Kingdom . |

*Primary Examiner*—Stephen J. Lechert, Jr.

*Attorney, Agent, or Firm*—Cushman, Darby & Cushman

[57] ABSTRACT

Apparatus for producing a multi-phase emulsion explosive from a liquid organic fuel medium and an immiscible liquid oxidizer comprises a mixing chamber, flow constrictor means for introducing the liquid oxidizer as an emergent turbulent jet to said chamber and causing formation of droplets of said oxidizer in situ within the chamber, means for introducing the fuel medium to said chamber so that the fuel introduced thereby contacts and stabilizes the droplets of oxidizer solution as they are formed to maintain same as discrete droplets of oxidizer liquid and thereby provide an emulsion suitable for use as the basis for an explosive system.

28 Claims, 29 Drawing Sheets

6" ø Chamber Live Formulation – AN/SN – $T_f$ 65°C
Paraffin Oil – SMO, 5:1
3/4 H7
x 1·1/2 H16
MINIMUM OIL (WEIGHT %)
7·0
6·0
5·0
4·0
3·0
2·0
1·0
0·0
0
50
100
150
200
SOLUTION FLOW RATE (Kg/min)

6" Ø Chamber. Live Formulation:- AN/SN Tf 65 °C
Paraffin Oil - SMO, 5:1
1/2 HH25
3/4 H4
1·1/2 HH16
MINIMUM OIL FLOW (WEIGHT %)
SOLUTION FLOW RATE (Kg/min)
0·0
1·0
2·0
3·0
4·0
5·0
6·0
7·0
0
50
100
150
200
250

Fig. 11 6"/10" Ø Chamber, 1 1/2 HIG Nozzle.

10" Ø Chamber.
11/2 H16 Nozzle
Live Formulation: Solution: AN/CN $T_f$ 39°C
Oil Phase: Various
* 4:1 FO/SMO
4:1/2:1/2, FO:SMO:E1
MINIMUM OIL (WEIGHT %)
7·0
6·0
5·0
4·0
3·0
2·0
150
175
200
225
250
SOLUTION FLOW RATE (Kg/min)

$\eta_{50°C}$ vs nozzle type
Spindle 6 @ 10 rpm
Live Product: Solution: AN/SN 65°$T_f$
Oil Phase: 1:5 SMO:FO
× HH16(ANGLE 70°)
* 30300(ANGLE 30°)
▫ 15280 (ANGLE 15°)
VISCOSITY × $10^{-3}$ (cps)
40
35
30
25
20
15
10
5
2·0
3·0
4·0
5·0
6·0
7·0
OIL CONTENT (WEIGHT %)

$\eta_{6\%\,Oil}$ vs temperature. Live Product – Solution: AN/SN 65"Tf
Spindle 6 @ 20 rpm
Oil Phase: 1:5 SMO:FO
× HH16 (70°)
▼ 30300 (30°)
VISCOSITY × $10^{-3}$ (cps)
14·0
12·0
10·0
8·0
0
10
20
30
40
50
60
70
80
90
100 °C
TEMPERATURE (°C)

Formulation as for Fig. 16
x 11/2" H16 ①
▲ 11/4" H30300 ②
• 1 H15280 ③
DROPLET DIAMETER (μm)
20
10
8
6
5
4
3
2
1
0
1
10
50
90
PERCENT GREATER THAN DIAMETER $\eta_{80°C}$ vs Oil Content. Live Product: Solution: AN/SN @5° $T_f$
Spindle @ 10 rpm. Oil Phase: 1:5 FO:EI
x NOZZLE 15280
127 L/min
▫ NOZZLE HH16
151 L/min
VISCOSITY x $10^{-3}$ (cps)
22
20
18
16
14
12
10
8
3·0
4·0
5·0
6·0
7·0
OIL CONTENT (WEIGHT %)

EXPLOSIVE EMULSIFICATION METHOD

The present invention relates to the manufacture of water-in-oil emulsions of high internal phase volume. More particularly, the invention relates to an apparatus and a method for the continuous manufacture of emulsions which are useful as the basis for an explosive system.

An emulsion is a mixture of two or more immiscible liquids, one of the liquids being present in the other liquid in the form of fine droplets. In industrial applications, emulsions generally comprise oil which is dispersed in an aqueous external phase or an aqueous phase dispersed in an oil external phase. These emulsions are generally known as oil-in-water emulsions and water-in-oil emulsions. Hereinafter, these emulsions will generally be referred to as oil/water emulsions.

Emulsions find use in a wide range of industrial applications, for example, in food, cosmetics, paints and pharmaceuticals, agriculture chemicals, cleaning compositions, textile and leather, metal treatment, commercial explosives and oil refining. Emulsions may be prepared in a wide variety of forms or consistencies. These forms range from emulsions wherein the two phases may be in approximately equal proportions to emulsions wherein one phase may comprise 90% or more of the total. Similarly, depending upon the intended end use for the emulsion, the particle size of the dispersed phase may be wide-ranging.

The particle size of a liquid emulsion is related, among other things, to its method of preparation, to the viscosity of the different phases and to the type and amount of the emulsification agent which is employed. As a consequence, emulsions may be very thin and fluid-like or may be very thick and paste-like. As the ratio of the internal and external phases is altered, the emulsion viscosity generally changes. When the proportion of internal phase is increased beyond 50% of the total volume, the viscosity of the emulsion increases so that the emulsion no longer remains fluid. Thus, by modifying the ratio of internal and external phases, a wide range of consistencies may be produced for specific end uses.

The apparatus employed to manufacture oil/water emulsions comprises any device which will break up the internal phase component and disperse the resulting particles throughout the external phase. Among the types of apparatus normally employed in the manufacture of emulsions are those which impart a vigorous stirring action, an aeration action and propeller and turbine agitation. The use of colloid mills, homogenization apparatus or ultrasonics is also common. Combinations of two or more of these methods may also be employed. The choice of the appropriate emulsifying equipment will depend upon the apparent viscosity of the mixture in its stages of manufacture, the amount of mechanical energy which is required, the heat exchange demands and particularly the ability of the equipment to produce a high internal phase water-in-oil emulsion. The choice of equipment will also depend on economic and safety factors.

For many industrial applications, the manufacture of emulsions on a continuous basis is desirable. In continuous manufacture, proportioned amounts of the discontinuous phase and the continuous phase of the eventual emulsion are first combined or mixed together and then exposed to continuous agitation or shear. The resulting emulsion is then continuously removed at the rate at which it is formed. For relatively coarse emulsions wherein the average particle size of the dispersed droplets is greater than about 10 microns (10 μm), a moderate shear mixing apparatus is sufficient. For highly refined emulsions of 2 μm or less average particle size., high shear mixing is required. Typical of the apparatus used for the continuous production of both coarse and fine explosive emulsions is the in-line or static mixer, such as, for example, the SULZER mixer. In an in-line mixer, the two phases are co-mingled and delivered under high pressure through a series of passages or orifices where the liquid streams are divided and recombined to form an emulsion. Such a mixer is disclosed, for example, by Power in U.S. Pat. No. 4,441,823. Relatively large amounts of energy are required for the efficient operation of an emulsifying in-line mixer. Ellis et al in U.S. Pat. No. 4,491,489 disclose the use of a two-stage continuous emulsifier wherein two or more static mixers are combined with an injection chamber. Gallagher, in U.S. Pat. No. 4,416,610 describes an oil/-water emulsifier which makes use of a Venturi member. Binet et al in U.S. Pat. No. 4,472,215 make use of a recirculation system in combination with in-line mixers.

While all of the aforesaid continuous emulsification methods and apparatus are meritorious, none completely satisfies the need for a simple, safe, easily maintained device which can be operated with a minimum of energy input. Furthermore, the use of multi-component emulsification mixers, particularly those which employ high shear, carries the ever-present risk of breakdown with consequent hazard when sensitive or explosive materials are being processed. In addition, the generation of heat by high-shear mixing devices is often deleterious to the emulsion. Furthermore, the production rates of high shear mixers are generally limited and often capital investment is high.

Accordingly it is an object of this invention to provide a method and an apparatus for the reliable manufacture of oil/water emulsions which can be used as a basis for explosive systems and which obviates or mitigates the known deficiencies of the prior art methods and apparatus.

It is a further object of this invention to provide a method and an apparatus for the safe and energy-efficient manufacture of oil/water emulsions on a continuous basis.

Therefore according to this invention there is provided a method for the continuous production of an oil/water emulsion explosive composition which method comprises simultaneously and continuously introducing into a mixing chamber separate liquid streams of a continuous phase component and an immiscible discontinuous phase component, the said immiscible discontinuous phase component being introduced into the said continuous phase through turbulence inducing means which constricts the flow of said immiscible discontinuous phase such as to cause its disruption to form fine droplets of a desired size upon its emergence into the mixing chamber, said turbulence inducing means further causing said immiscible discontinuous phase to emerge in a flow pattern and at a flow rate sufficient to cause the droplets so formed to entrain a sufficient quantity of the continuous phase component to provide for mixing thereof with the droplets to achieve stabilisation of same in the continuous phase and thereby continuously form said emulsion.

The said means for causing disruption of the discontinuous phase may be any form of pressure atomiser i.e. a device wherein liquid is forced under pressure through an orifice to discharge in the form of droplets of a size acceptable for the purpose defined herein.

Thus it will be appreciated that this method has the advantage that the desired emulsion can be produced in only one mixing step without reliance on liquid-liquid shear to cause droplet formation and so the use of the expensive and energy inefficient shear mixing devices typically required is avoided.

Preferably the flow of said immiscible discontinuous phase is constricted by means of an orifice in said turbulence-inducing means wherein the path length ($L_n$) through said orifice is short i.e. less than 0.01 m and preferably less than 0.005 m so as to provide for the greatest pressure gradient with minimum losses in energy. The diameter of the orifice $D_o$(m) should be selected in accordance with the intended volume flow rate Q ($m^3.s^{-1}$) and the desired droplet size. It can be shown that maximum possible droplet size $$D_{max} \propto \frac{D_o^{3/2}}{Q^{3/4}}$$

(assuming that no mechanism for coalescence exists) so that for constant drop size, if flow rate is increased e.g. 7 fold the nozzle diameter should be increased approximately 2 fold. Suitable orifice sizes for the purposes set out herein are in the range of about 0.001 m to about 0.02 m, preferably from 0.005 m to about 0.015 m.

Preferably the means for causing disruption of the discontinuous phase is a nozzle which discharges into the mixing chamber, advantageously in a readily replaceable manner for the purposes of nozzle exchange or cleaning, which nozzle is adapted to constrict flow sufficiently to cause turbulence in the stream of discontinuous phase to provide for discharge of dispersed single phase droplets of a size comparable to the eddies in the flow created within the nozzle in use under operating conditions. The advantage of this arrangement is that it provides for localised break up of a single phase directly into another mixed phase which provides for localised energy dissipation and very efficient energy transfer. Thus preferred arrangements provide for local energy dissipation rates ($\epsilon$) in the range of from $10^4$ to $10^8$ W/kg with most preferred rates being in excess of $10^6$ W/kg. Energy dissipation rate is routinely calculated (assuming Newtonian liquid behaviour) from knowledge of the path length $L_n$ (m) through the orifice of the nozzle, the pressure drop $VP_n$ ($N.m^{-2}$) across the nozzle, the density $\rho_F$ ($kg.m^{-3}$) of the continuous phase and the mean fluid velocity $\overline{U}$ ($m.s^{-1}$) all of which can be readily measured. The pressure drop across the nozzle for a sharp edged orifice is shown by the following equation :

$$P_n = 1/2\ \rho_F U^2 \qquad (1)$$

and since d/dt(E)=P=work done/unit time=$F\overline{U}$ and $\epsilon$=P/m i.e. (W/kg) then the specific power dissipation $\epsilon$ may be written as $$\epsilon = \frac{\nabla P_n}{\rho_F} U \qquad (2)$$

where $\nabla P_n = \Delta P_n / L_n$ and from (1) we have $\epsilon = \frac{1}{2}\overline{U}^3/L_n$. By virtue of this invention, selected droplet sizes are obtainable such that the average droplet size lies in a narrow range so that high populations of droplets of less than 8 μm, preferably of about 4 μm or less, down to about 0.5 μm are consistently achievable. Ordinarily it will be found that for a given set of process conditions droplet sizes will lie within a relatively narrow range (save for a small proportion of droplets which arise from coalescence of formed droplets). Thus for example taking a flow rate of say 20 $l.m^{-1}$ for the discontinuous phase stream through a 4.6 mm diameter orifice, $D_{max}$=13 μm where $$D_{max} \approx \left(\frac{8\gamma}{C_D \rho C}\right)^{3/5} \epsilon^{-2/5}.$$

whilst $D_{average}$=3 μm, where $$D_{average} \approx (U^3/\epsilon)^{1/4}$$

where $\gamma$=interfacial tension ($N.m^{-1}$)

$C_D$=drag coefficient of droplet $\rho_C$=density of the continuous phase ($kg.m^{-3}$)

$\epsilon$=specific energy dissipation rate ($W.kg^{-1}$)

U=dynamic continuous phase velocity ($m^2.s^{-1}$)

Thus the droplet size, and hence the fineness of resultant product emulsion, is controllable by flow rate and orifice dimensions. Flow of the discontinuous phase is essentially turbulent and desirably is isotropic turbulent flow. The velocities of flow and hence bulk Reynolds numbers (Re) associated with these conditions are in the range of from 30,000 to 500,000, and preferably upwards of 50,000. The rate of flow of each stream is preferably controlled to provide for ratios of continuous phase to discontinuous phase in the range of from 3:97 to 8:92, preferably around 6:94.

More preferably the nozzle is one capable of discharging a turbulent stream as a transient divergent sheet producing a divergent pattern ("solid cone") of droplets and may or may not impart a rotational motion element to said droplets. Such flow patterns may be obtained by use of nozzles known from the spray-drying art.

The nozzle preferably includes internal baffles or other means defining one or more tangential or helical passages to provide for a radial (helical) emergent flow superimposed on a linear divergent flow to produce a resultant helical flow which serves to enhance dispersion of the droplets rapidly formed on discharge. The advantage of this arrangement is that the helical flow creates a pressure gradient along the notional jet boundary which facilitates entrainment of continuous phase and mixing of droplets with the continuously formed emulsion.

The nozzle preferably has an exit cone angle of 70° or less. Emulsion product viscosity has been found to rise with decrease in emergent stream cone angle so that preferably the nozzle cone angle is less than 30° and the system operates favourably at 15° or less. At 0° or very low exit nozzle cone angles there is a pronounced tendency to produce a collimated narrow stream of discontinuous phase at higher stream velocities which is unsatisfactory for rapid emulsion formation; Nevertheless, at controlled stream velocities the interactions inherently causing divergence of the emergent flow may be fully adequate for emulsion formation.

Operating pressures (back pressure in nozzle) are suitably in the range of from 10 psi to 200 psi, preferably 30 psi to 135 psi and upwards, bearing in mind that the higher the pressure used the greater the energy available for droplet creation, the finer the resultant emulsion and the greater the viscosity of the product becomes but it is likely that pressures exceeding 160 psi would be unnecessary for normal purposes.

The linear fluid velocity through the nozzle is typically from 5 to 40 $ms^{-1}$ and average droplet sizes of from 7 to 10 down to 1 or less μm are achieved.

As mentioned above preferred nozzles are characterised by short and narrow constrictions so that the stream of discontinuous phase passes rapidly through the nozzle constriction under a high pressure gradient. Nozzles which have been tested and found suitable for the purposes of this invention are commercially available (Spraying Systems Co., Wheaton, Ill., U.S.A.) and are identified in Table I

TABLE I

| Nozzle Type | Orifice Diameter (mm) | Cone Angle | Nominal Capacity at 75 psi ($l.m^{-1}$) |
|---|---|---|---|
| ½ H25 | 4.6 | 61–67° | 21 |
| ⅜ H27W | 4.7 | 106–121° | 22 |
| ¾ H4 | 6.4 | 63–67° | 40 |
| ¾ H7 | 9.5 | 84–92° | 70 |
| 1 H15280 | 9.9 | 15° | 127 |
| 1 H30300 | 10.5 | 30° | 132 |
| 1¼ H10 | 9.6 | 61–67° | 100 |
| 1½ H16 | 12.7 | 67–74° | 153 |

Preferably the dimensions of the mixing chamber are such as to minimise impingement of droplets on the walls of the chamber so as to mitigate the problem of coalescence of the droplets prior to droplet stabilisation. In other words the zone of droplet formation and initial dispersion should be remote from boundary surfaces. Conveniently the mixing chamber is a cylindrical vessel having removable end closures, one of which has means providing for removal of continuously formed emulsion product. The removal of product is desirably continuous but it is possible to provide for continual removal of batches of product at selected intervals depending upon the capacity of the mixing chamber and rate of production of the emulsion. The latter possibility will be embraced in the term "continuous" production hereinafter. The mixing chamber may form part of bulk emulsion production equipment, or be part of a fixed installation as when a packaged product is desired. If an explosive emulsion composition is required to be sensitised by gassing or by introduction of closed cell "void-containing" material (e.g. glass microballoons) or to have particulate material such as aluminium incorporated therein prior to use, the emulsification equipment may discharge directly to appropriate downstream treatment stages. However, in the case of chemical gassing, the short residence time of the discontinuous phase (aqueous) in the nozzle and in the mixing chamber in the region of emulsion formation which can be achieved by the present invention admits the possibility of incorporating the chemical gassing reactant (e.g. sodium nitrite) in the aqueous phase prior to it passing through the nozzle. Again in view of the high production rate achievable by the present invention using relatively small equipment (e.g. a chamber of 6–10" diameter) a manually manipulatable emulsion formation device can be envisaged.

Preferably also the continuous phase stream (oil plus surfactant) is fed through a pipe passing directly into the chamber in the region of droplet discharge from the nozzle and which is located adjacent to, but spaced sufficiently from the nozzle to minimise coalescence of droplets whilst enabling entrainment of the continuous phase stream in said droplet discharge. A suitable arrangement is to provide the nozzle centrally in an end wall of a cylindrical vessel defining the mixing chamber and to have the pipe for discharge of continuous phase passing through the cylindrical wall to emerge at a position close to the nozzle allowing said continuous phase stream to contact the droplets discharged by said nozzle and pass into the continuously formed emulsion.

It will be evident that under steady state conditions of operation the formed droplets will encounter preformed emulsion enriched in continuous phase. At start-up the mixing chamber may be occupied by continuous phase, preformed emulsion, or a mixture thereof. The stream of continuous phase may be purely an oil stream or an oil-rich preformed emulsion.

It will also be appreciated that for product stability suitable surfactants ("emulsifiers") will be present, being introduced in solution in the oil or continuous phase.

Suitable emulsifiers for given emulsion systems are known in the art, preferred emulsifiers for emulsion explosive compositions being sorbitan esters (mono- and sesquioleates; SMO and SSO resp.) and the reaction product of polyisobutenyl succinic anhydride (PIBSA) and a hydrophilic head group such as an ethanolamine or substituted ethanolamine e.g. mono- and diethanolamines such as those disclosed in EP-A-No. 0 155 800. Mixtures of a PIBSA-based emulsifier (which provides for long term storage stability) and a more conventional emulsifier such as a sorbitan ester (which provides rapid droplet stabilisation and so resists any tendency for droplet coalescence) are especially preferred in the method of this invention.

The point or points of discharge of the continuous phase into the mixing chamber are capable of substantial adjustment both laterally (i.e. at right angles to the length dimension of the chamber) and longitudinally (i.e. along the length of the chamber), although probably there will be a longitudinal position beyond which insufficient entrainment (back mixing) of continuous phase will occur and emulsion formation will be defeated. Having regard to the range of rates of emulsion formation achievable satisfactorily with a single nozzle, a plurality of nozzles for the discontinuous phase are unlikely to be required or desired but practical arrangements with a plurality of nozzles can be envisaged.

The invention in one preferred aspect provides a process for producing a multi-phase emulsion explosive comprising forming a turbulent jet of a discontinuous phase oxidiser component having a Reynolds number of greater than about 50,000 to produce droplets of a selected size within the range of from about 1 to 10 μm diameter and contacting said jet continuously in the region of droplet formation with an organic fuel continuous phase medium in the presence of an emulsifier and in an amount which is sufficient to provide droplet stabilisation and sustain formation of the resulting emulsion.

Most preferably the predominant droplet size is about 1 to 2 μm for a packaged product and 3 to 5 μm for a bulk product. "Size" means the number average droplet diameter.

We have found that when operating at low flow rates, in the range of about 10 to 50 kg.min$^{-1}$ or less, to produce emulsions of lower fuel (oil) content having equivalent characteristics to those produced at higher flow rates it is desirable to provide a constriction in the path of the emulsion formed in the chamber prior to removal of that emulsion from the chamber to restrict the flow of the emulsion issuing from the chamber. Conveniently the said constriction may be provided in an outlet port in an end wall of the chamber through which formed emulsion is removed. The observed effect of the constriction is improved emulsion formation at lower flow rates for emulsions of lower oil content. Thus for example using a 2" (50 mm) diameter chamber with a ½" (13 mm) diameter outlet port, it is possible to make emulsions with oil contents of less than 7% by mass which do not exhibit sweating or incomplete solution incorporation. However when manufacturing an emulsion with an oil content of greater than 7% by mass at lower flow rates the constriction appears to be optional since such emulsions are not noticeably improved when such a constriction is present.

Whilst not wishing to be bound by any theoretical considerations at this time it is postulated that the constriction serves to induce a greater degree of back flow within the chamber or create turbulence sufficient to incorporate any solution which has not yet been emulsified.

This invention further provides apparatus for producing a multi-phase emulsion explosive from a liquid organic fuel medium containing an emulsifier and an immiscible liquid oxidiser which comprises a mixing chamber, flow constrictor means for introducing the liquid oxidiser as an emergent turbulent jet to said chamber and causing formation of droplets of said oxidiser in situ within the chamber, means for introducing the fuel medium to said chamber so that the fuel introduced thereby contacts and stabilises the droplets of oxidiser solution as they are formed to maintain same as discrete droplets of oxidiser liquid and thereby provide an emulsion suitable for use as the basis for an explosive system.

Employing prior art emulsification apparatus wherein one phase is injected into a second phase (see, for example, U.S. Pat. No. 4,491,489), use is made of a velocity gradient between the phases which provides a shearing force which creates a series of small droplets. Such shearing action is generally incapable of producing very fine droplets except under extreme conditions. Normally, liquid/liquid shearing action must be followed by further refining (e.g., an in-line mixer) in order to produce fine, stable emulsions. In the method of the present invention, no reliance is made on a velocity gradient between the phases and consequent liquid/liquid shear. Instead, fine droplets are produced from the discontinuous phase material which droplets are thereafter distributed throughout the continuous phase material. The degree of atomization and, consequently, the droplet size of the discontinuous phase, can be adjusted by selecting the appropriate atomizing nozzle. The particle or droplet size distribution of the discontinuous phase is narrow.

The invention will now be further described by way of the following Examples and with reference to the accompanying drawings in which.

Figure 4:
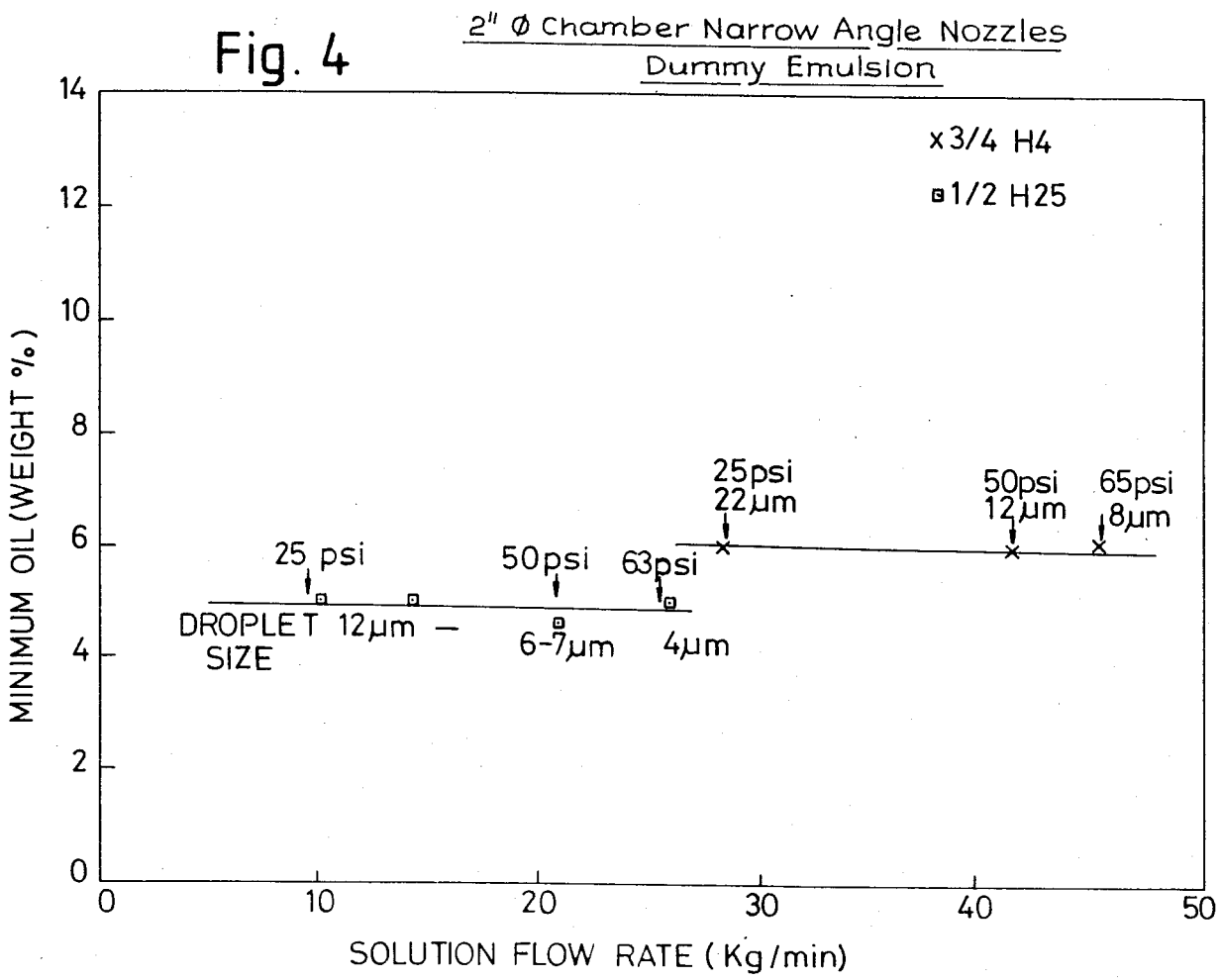
FIG. 4 is a graph illustrating the performance of two nozzles having narrow cone angle; ¾ H4 63°–70° and ½ H25 61°–67° in a 2" diameter chamber at relatively low flow rates using a dummy (non-explosive) formulation - the higher minimum oil contents observed for the ¾ H4-nozzle can be attributed to the effect of cylinder diameter.
Figure 5:
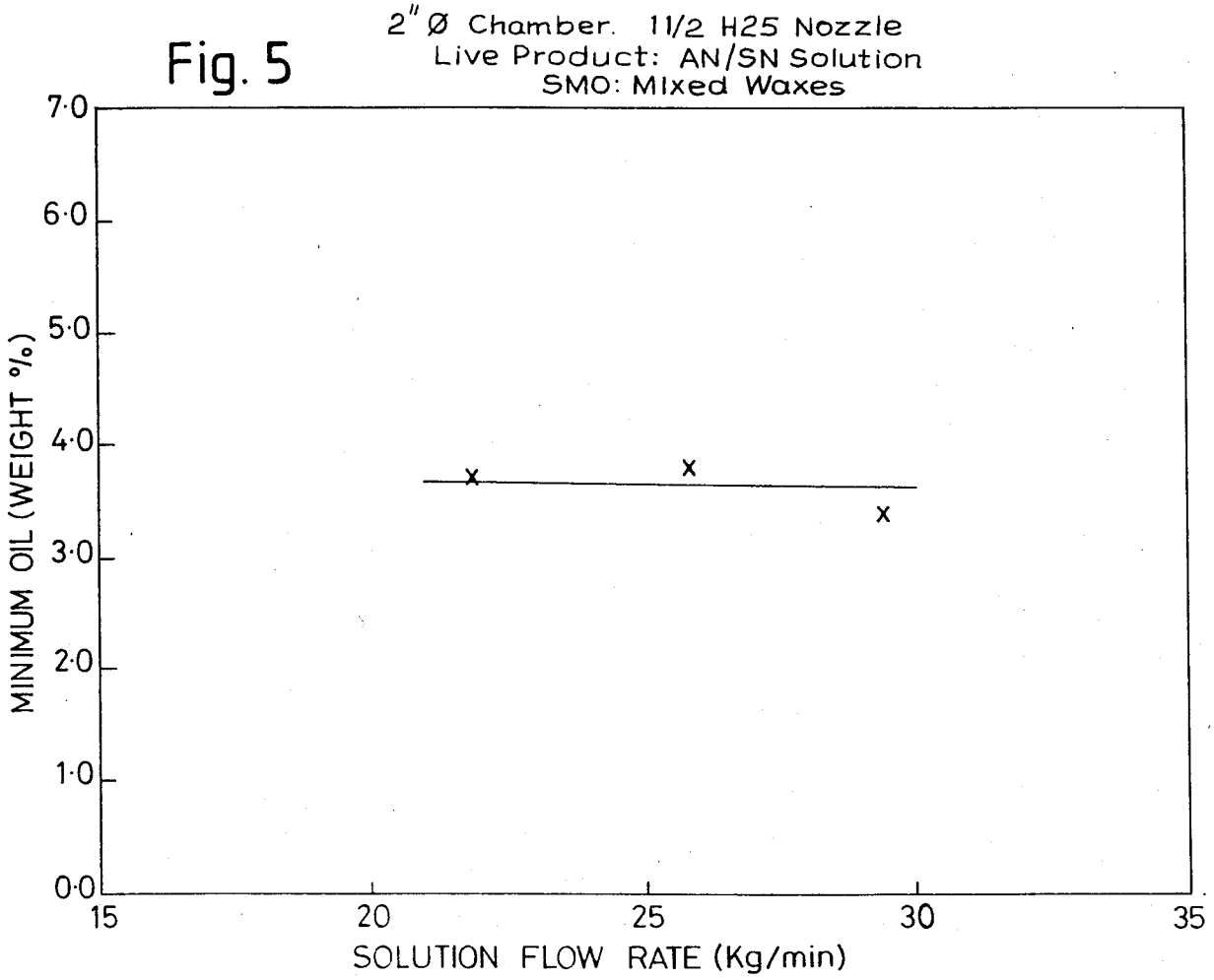
FIG. 5 is a graph illustrating the performance of the ½ H25 nozzle using a live (explosive) formulation.
Figure 6:
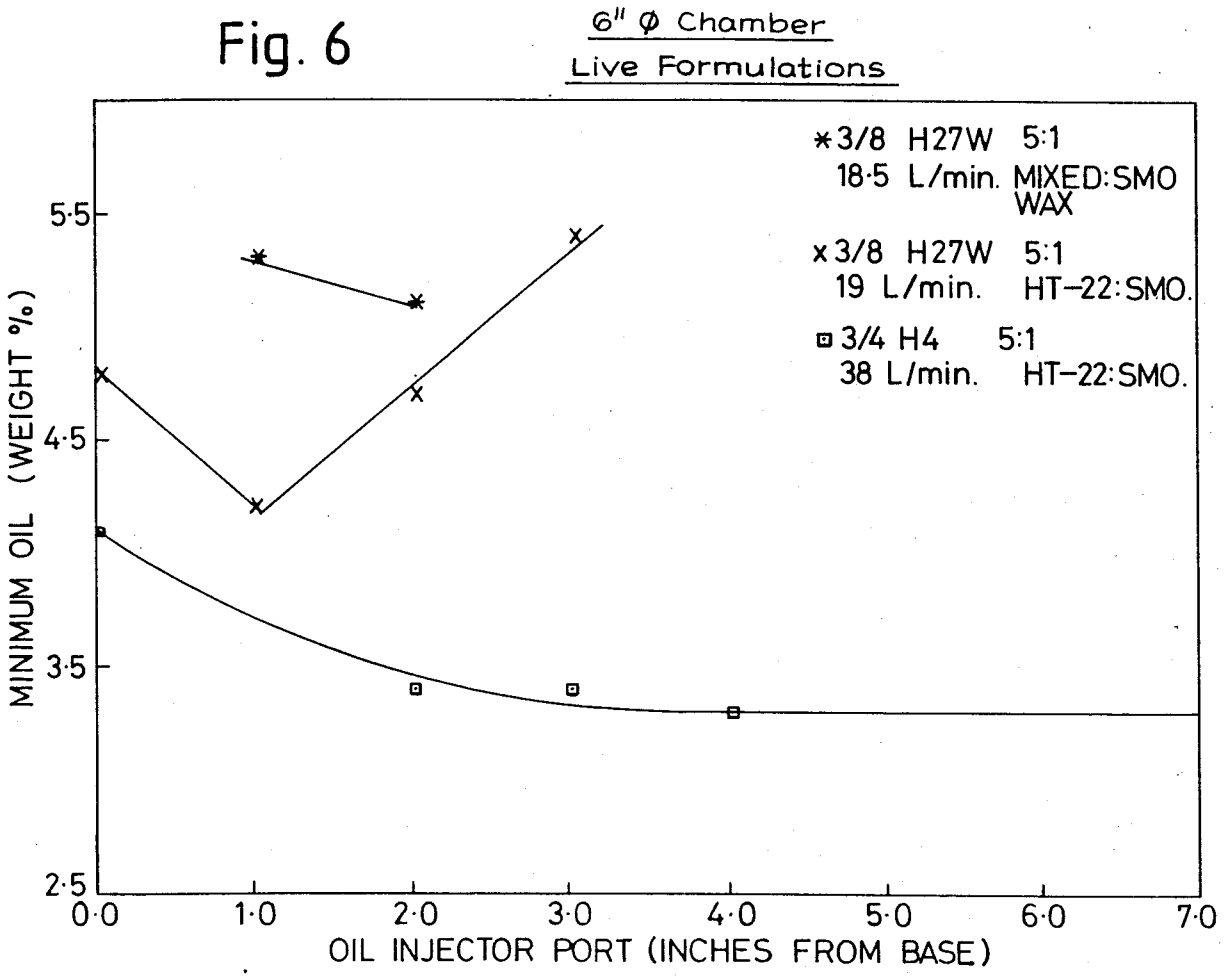
FIG. 6 is a graph showing the effect of changing the position of discharge of the continuous phase (oil/oil-rich). Injector port positions were spaced 1" (25.4 mm) apart, the first being as close as possible to the base of the mixing chamber which had a 6" (152.4 mm) diameter.

In the apparatus of this invention it has been observed that the emergent stream of discontinuous phase is fragmented into drops within about 0.5 mm, typically within 0.2 mm of nozzle exit. As is shown in FIG. 6 it is desirable to avoid impingement of droplets on boundary surfaces if the risks of coalescence are to be minimised. Thus it can be seen that the minimum oil content achievable with the ¾ H4 nozzle did not vary significantly with injector position and was improved over that obtained with the 2" diameter chamber (cf FIG. 4). The performance of the ⅜ H27W nozzle was significantly inferior to that of the ¾ H4 and this could be attributed to coalescence of the droplets as they strike the chamber wall. Using wider cone angle nozzles it is to be expected that impact on the side wall will take place in a shorter period of time. Thus the ⅜ H27W nozzle (cone angle 120°) will give inferior results to the ¾ H4 nozzle (cone angle 65°) if droplet stabilisation has not taken place prior to contact with the side wall.

Figure 7:
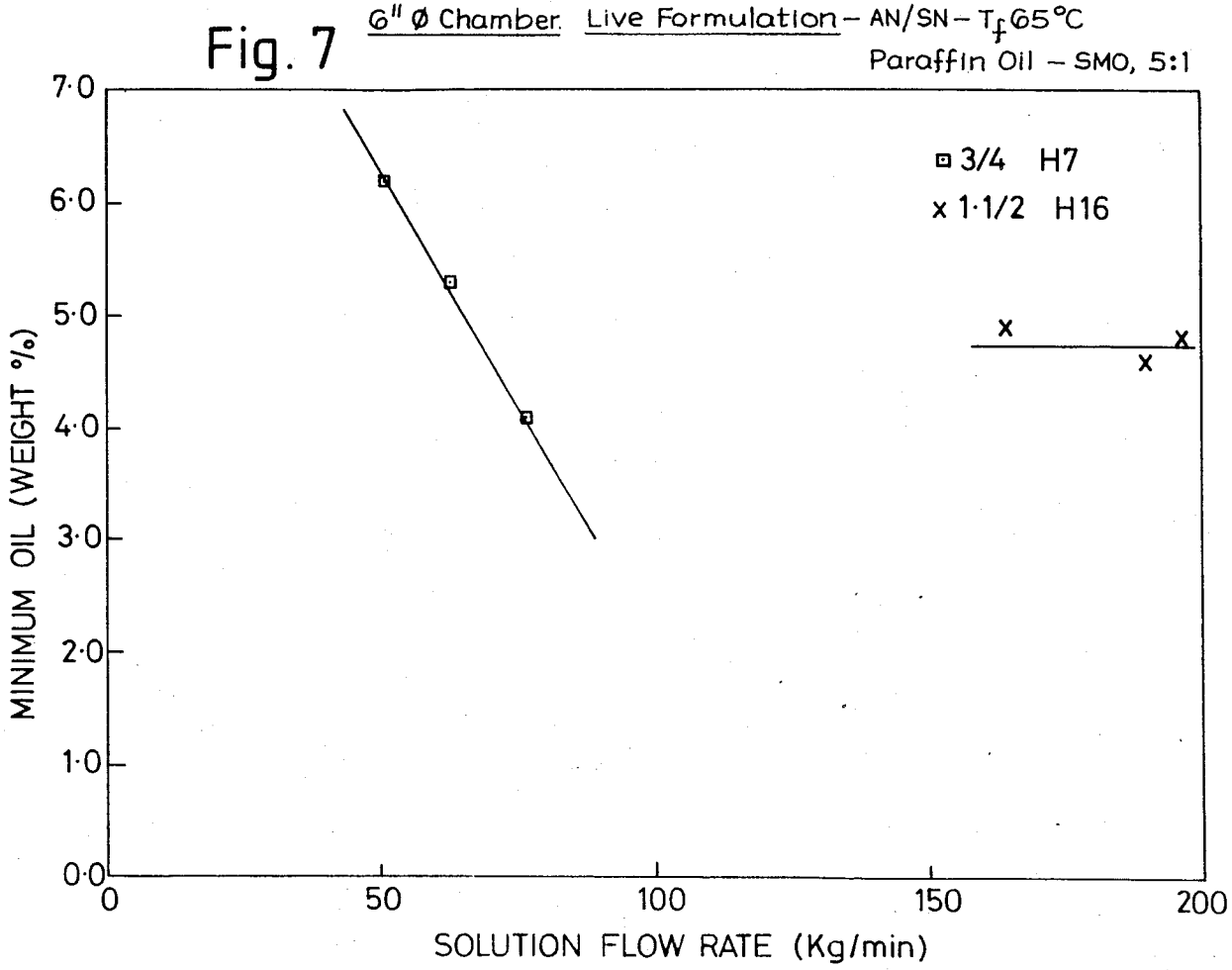
FIG. 7 is a graph showing the minimum oil contents observed for a live formulation at different flow rates and with different nozzles (¾ H7 and 1½ H16)
Figure 8:
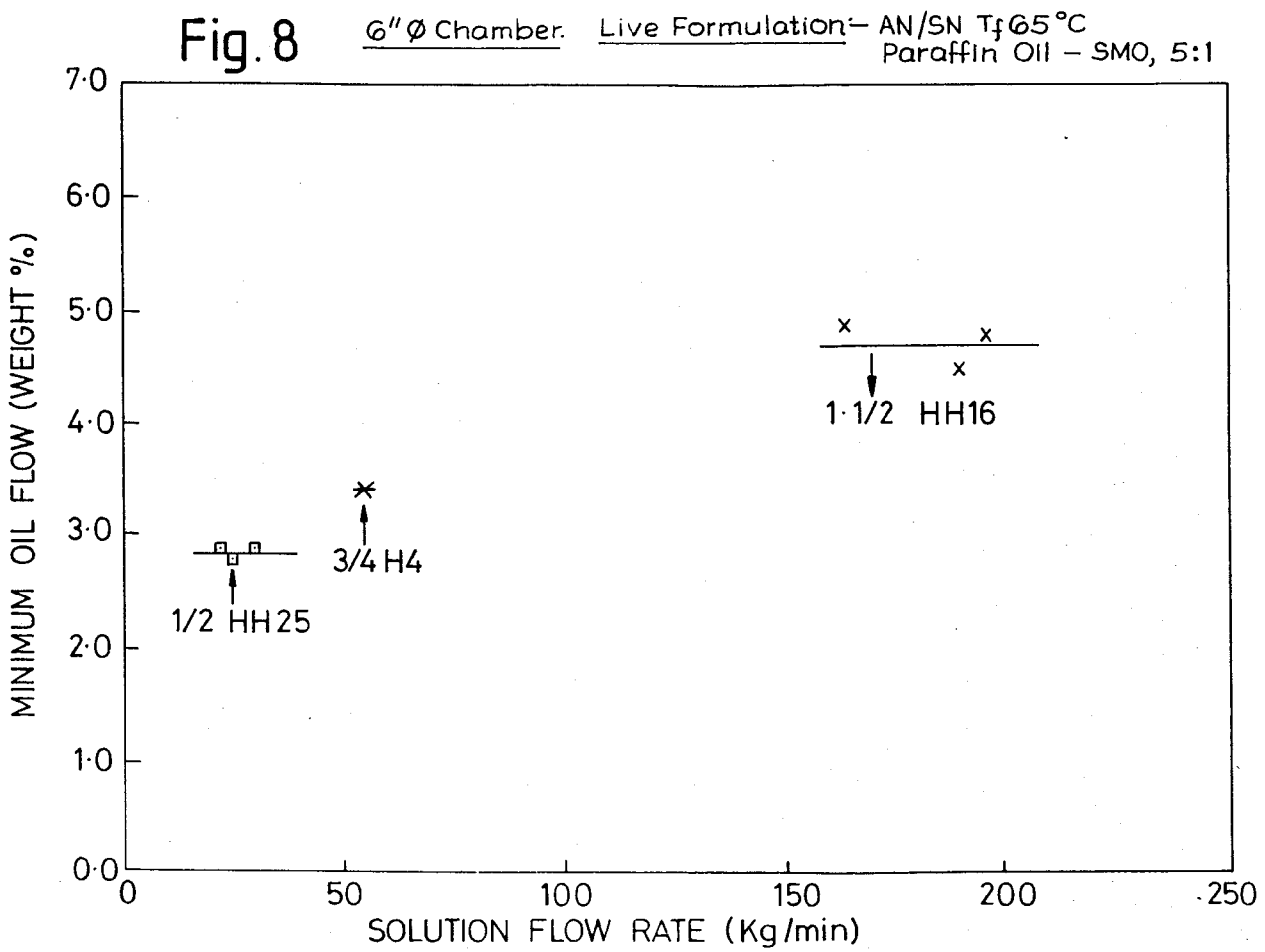
FIG. 8 is a further graph showing the minimum oil contents observed for a live formulation at different flow rates and with different nozzles (¾ HH25, ¾ HH4 and 1½ HH16)

Considering the results shown in FIG. 7, improved performance appears to occur as the flow rate is increased. This may infer that for this particular nozzle (¾ H7 - cone angle 85°-90°) in the 6" diameter cylindrical mixing chamber, coalescence is the dominant influence at lower flow rates (energy densities). As the energy density is increased its effect dominates the coalescence phenomenon.

Figure 9:
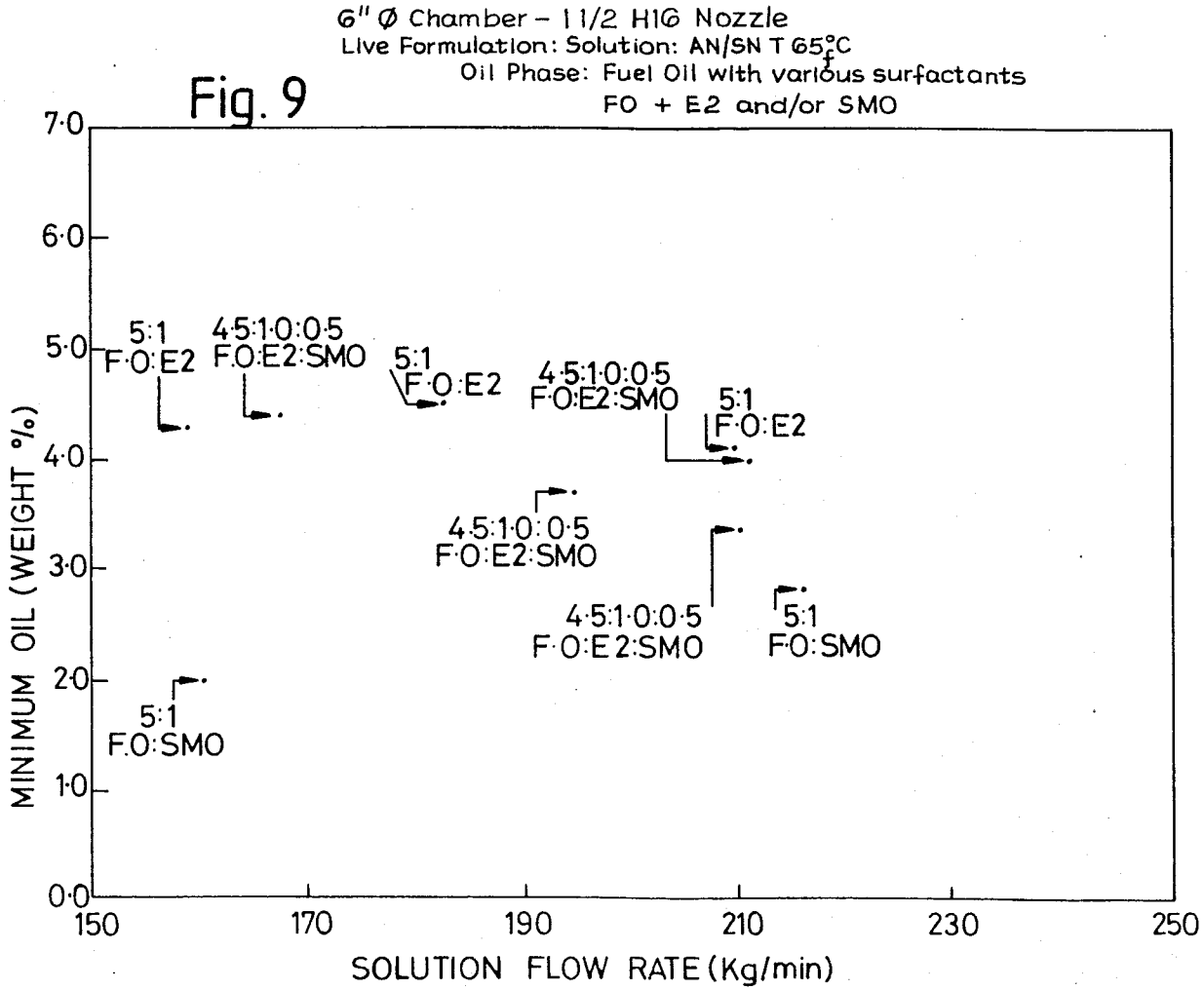
FIG. 9 shows the effect of the nature of the oil phase on process capability by plotting minimum oil content of product versus solution flow rate when the oil phases tested (fuel oil basis) incorporate a variety of differing surfactants.
Figure 10:
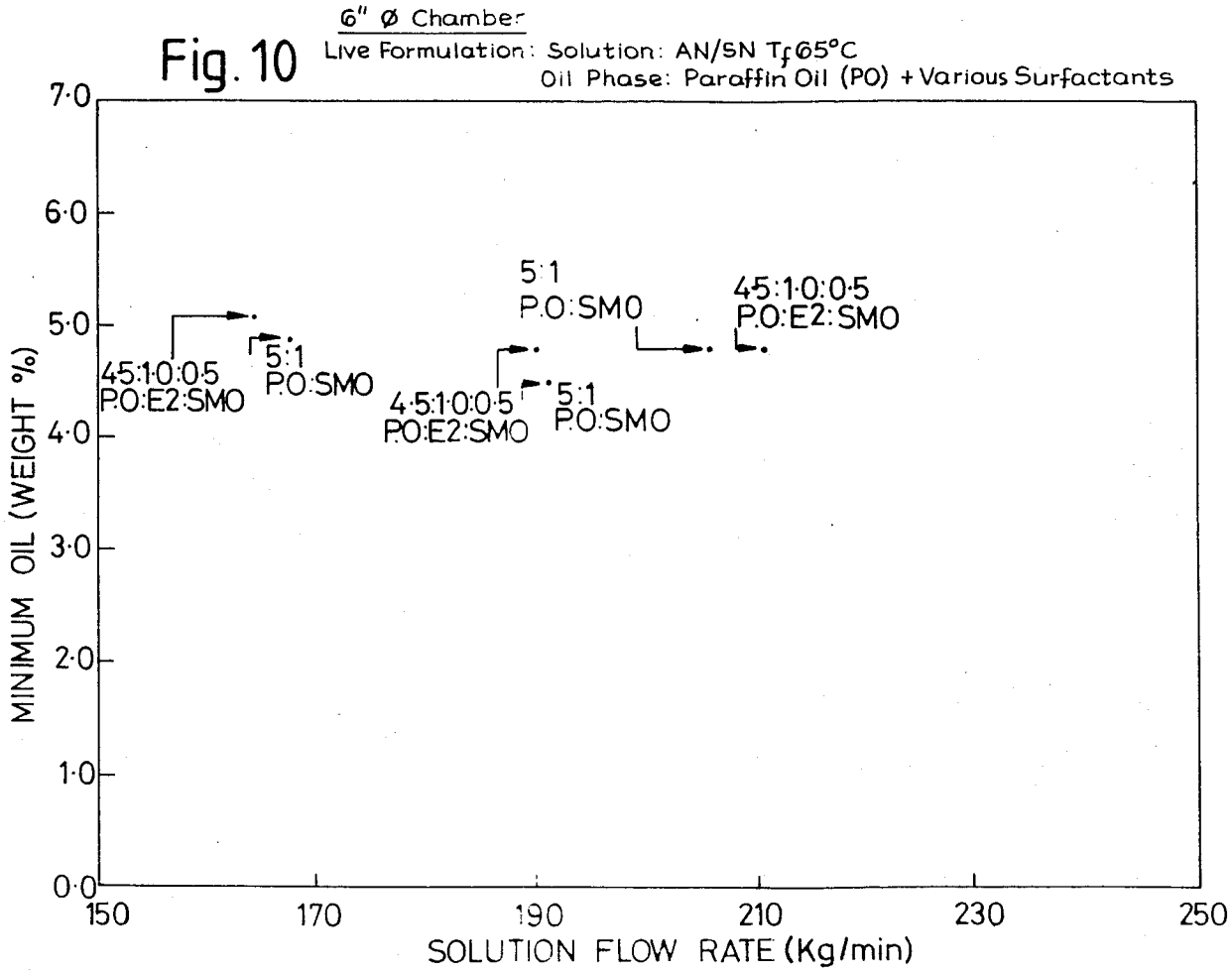
FIG. 10 is similar to FIG. 9 except that the oil phase was based on paraffin.
Figure 11:
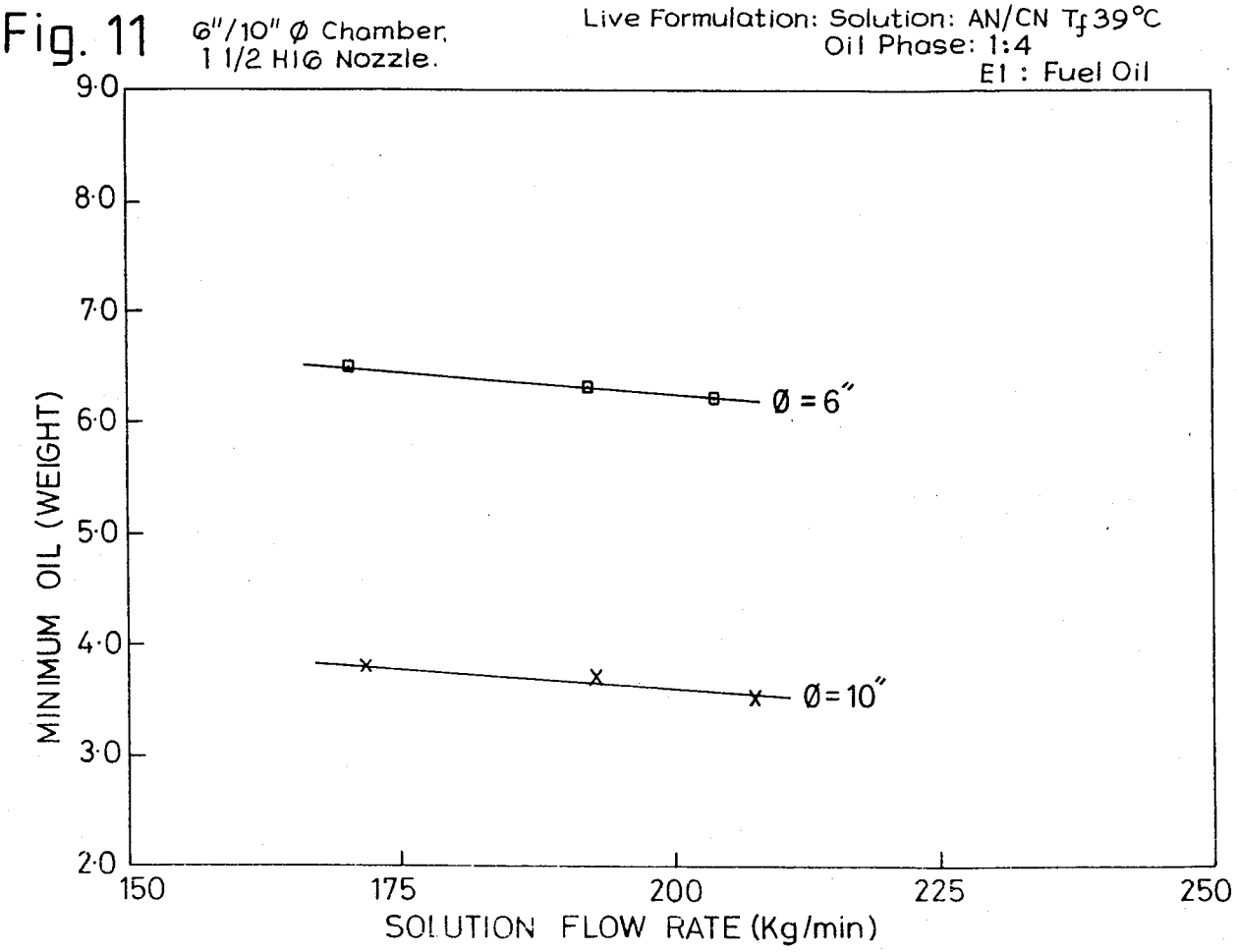
FIG. 11 shows a plot of results obtained using a 10" diameter mixing chamber in comparison with a 6" diameter mixing chamber the former showing an improved performance.
Figure 12:
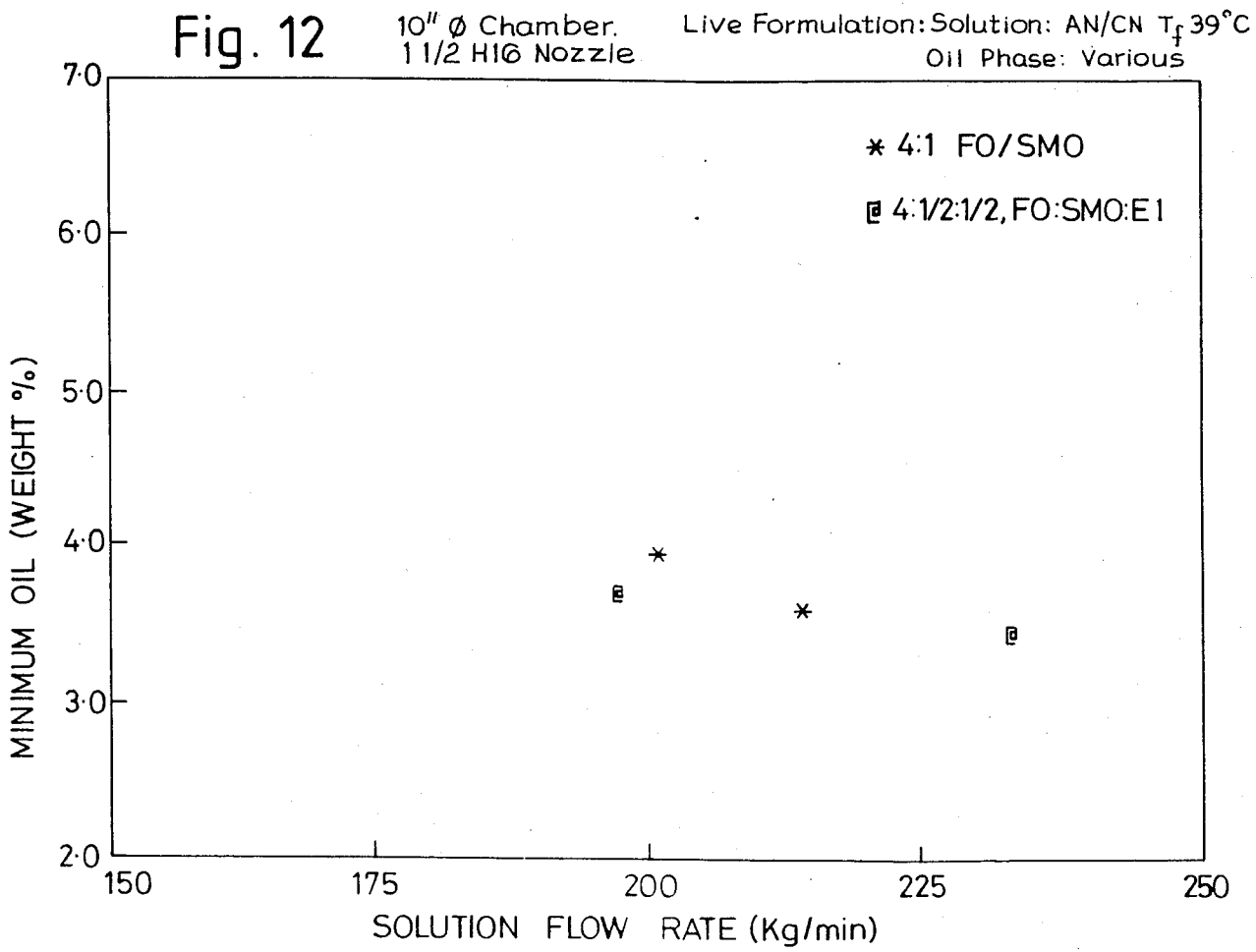
FIGS. 12 and 13 show attainable minimum oil contents for various oil phases using ammonium nitrate-calcium nitrate or ammonium nitrate only phases.
Figure 13:
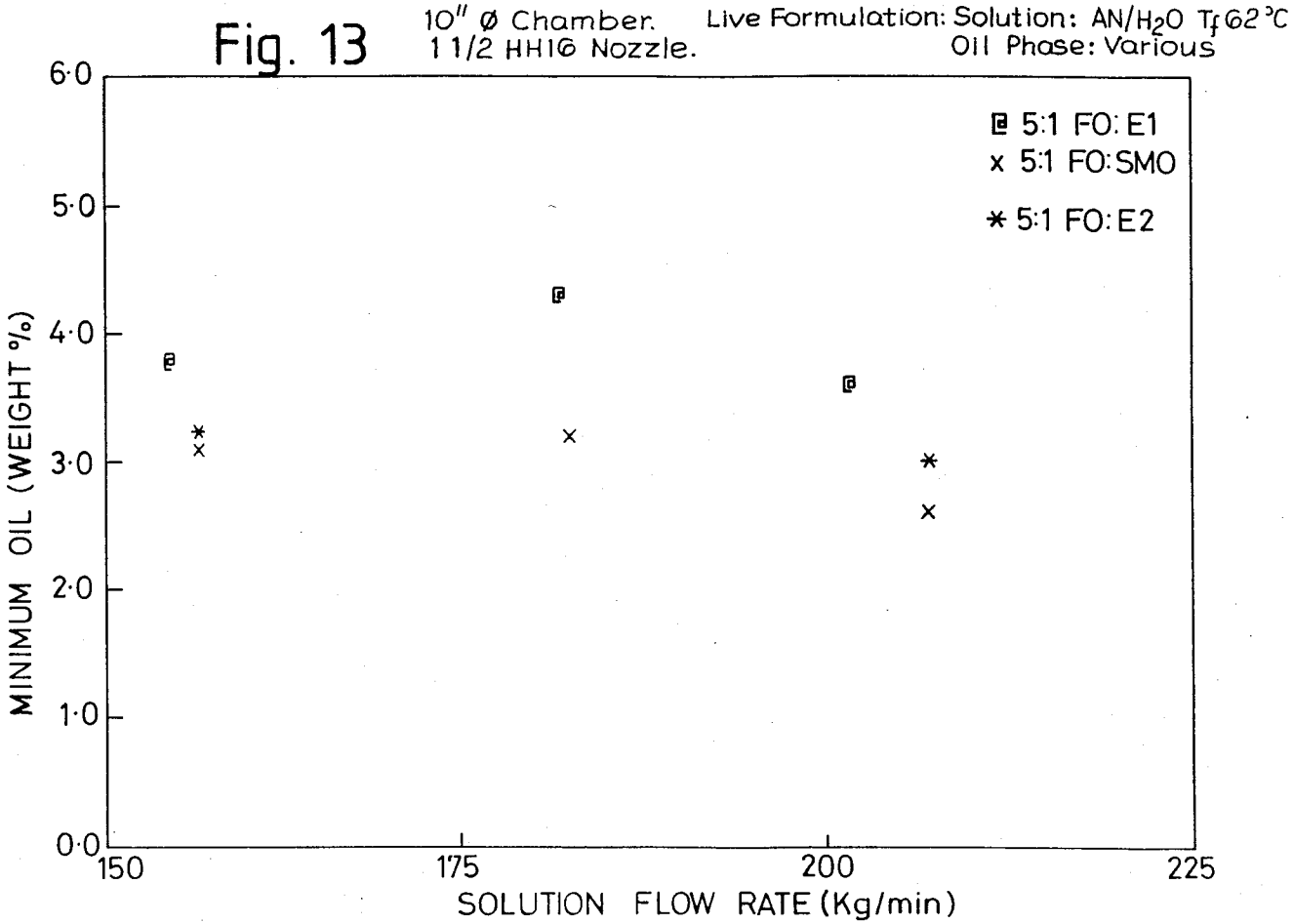
Figure 14:
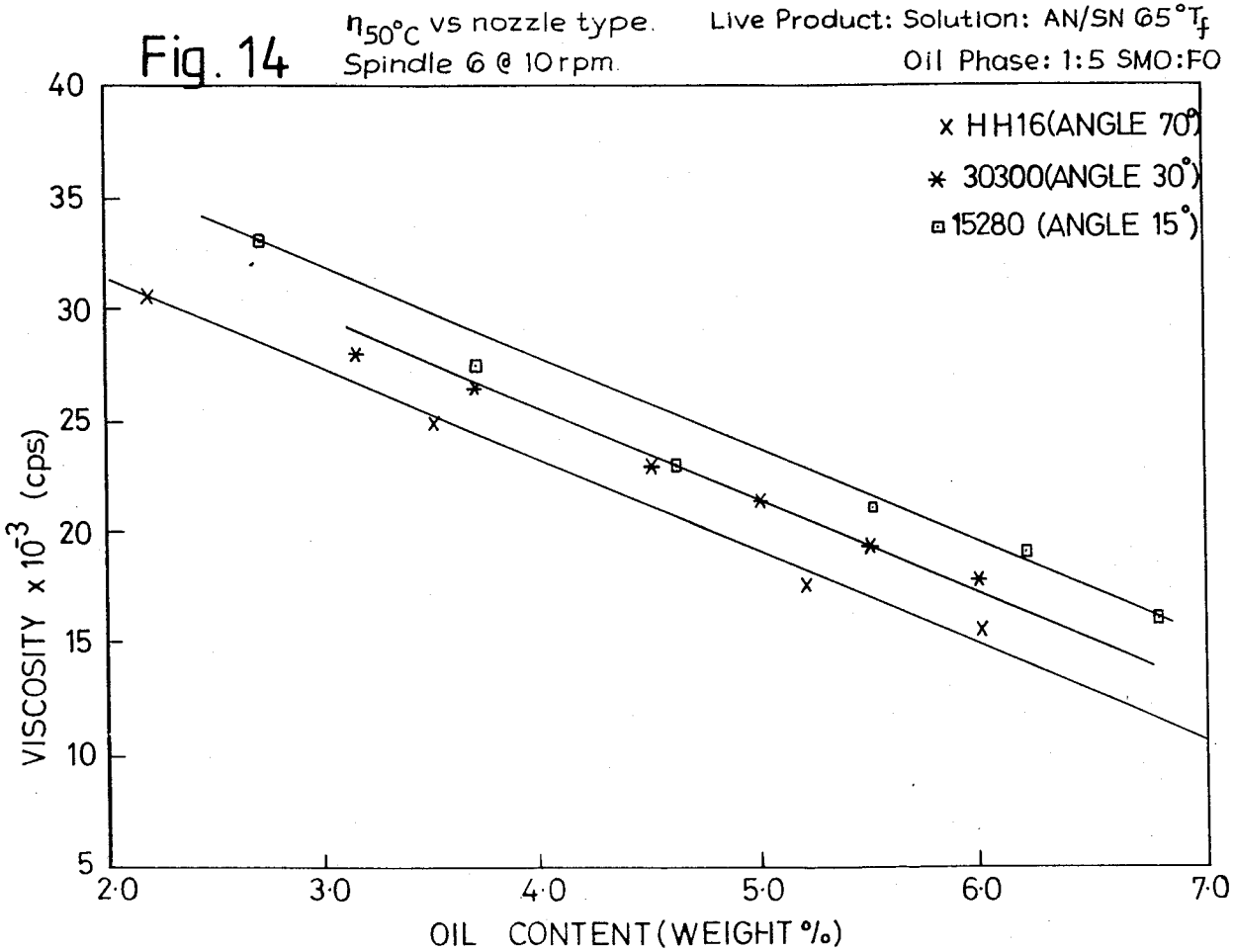
FIG. 14 is a graph which illustrates the effect of nozzle cone angle on product viscosity at 50° C. and 75 psi i.e. a decrease in cone angle results in an increase in product viscosity.
Figure 15:
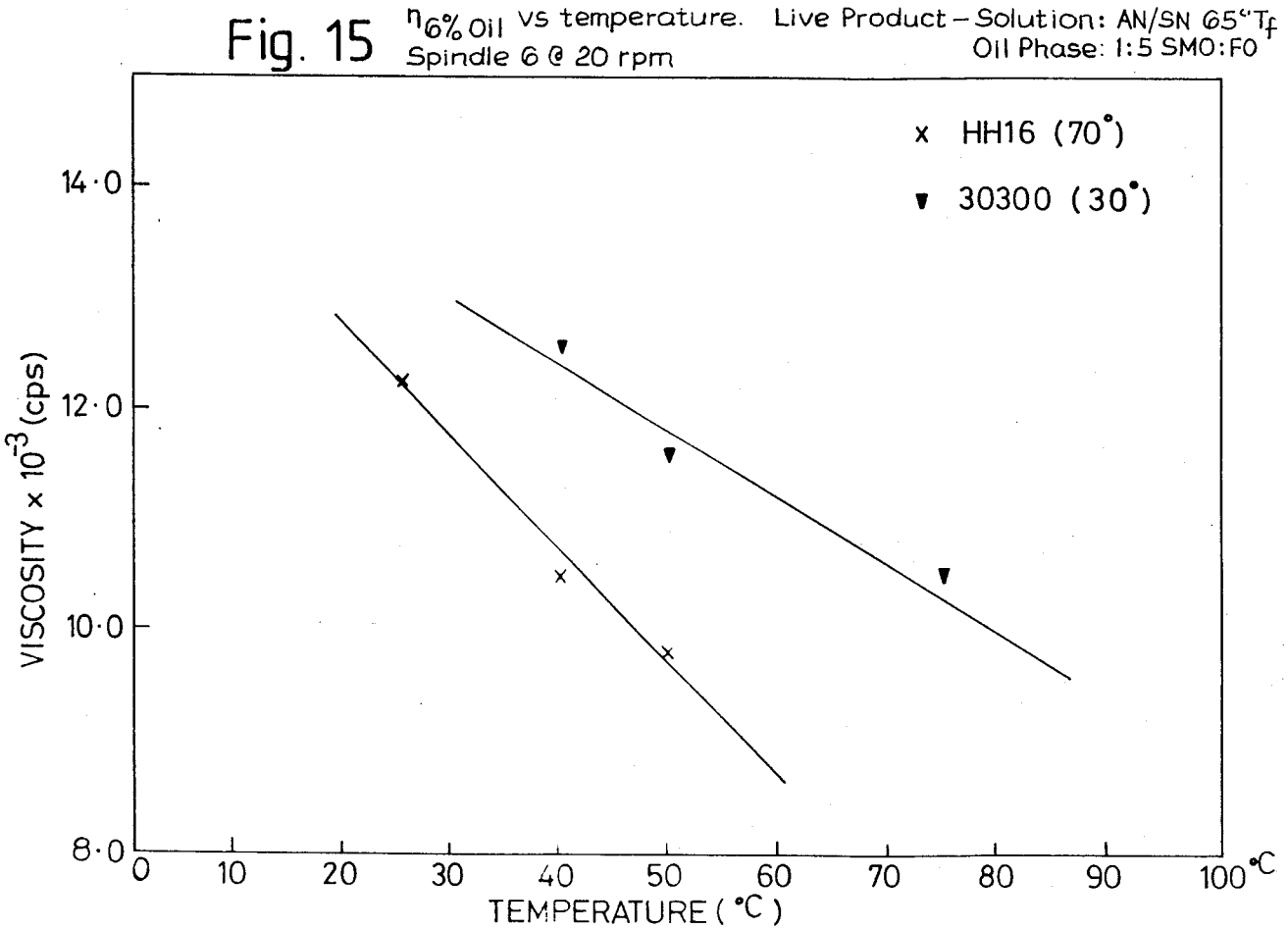
FIG. 15 is a graph which illustrates the effect of temperature at constant phase volume ratio (and constant pressure across the nozzle - 75 psi) for the same product made with nozzles of 70° and 30° cone angles.
Figure 16:
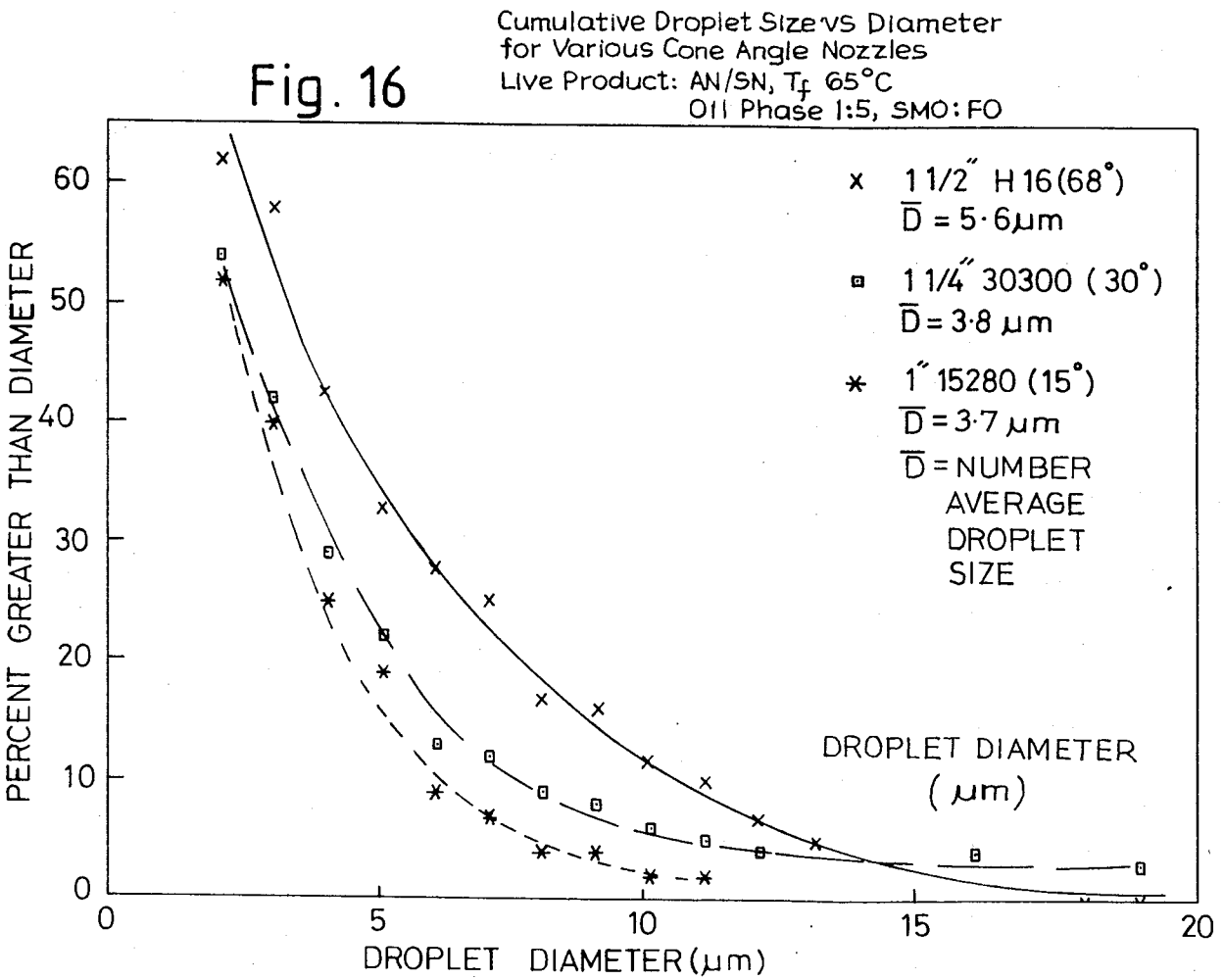
FIGS. 16 and 17 are plots of cumulative droplet sizes versus droplet diameter for various nozzles having differing cone angles based on use of a live formulation at 65° C. and 75 psi across the nozzle.
Figure 17:
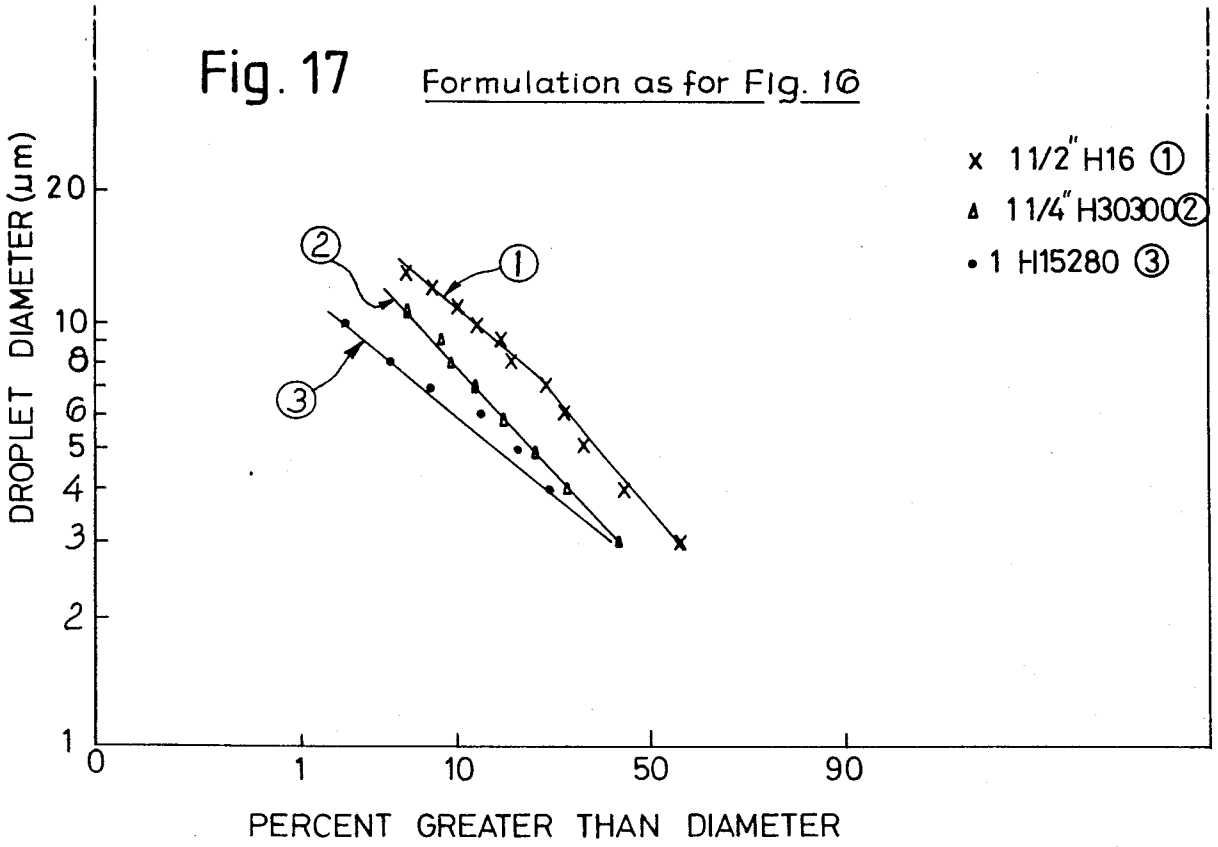
Figure 18:
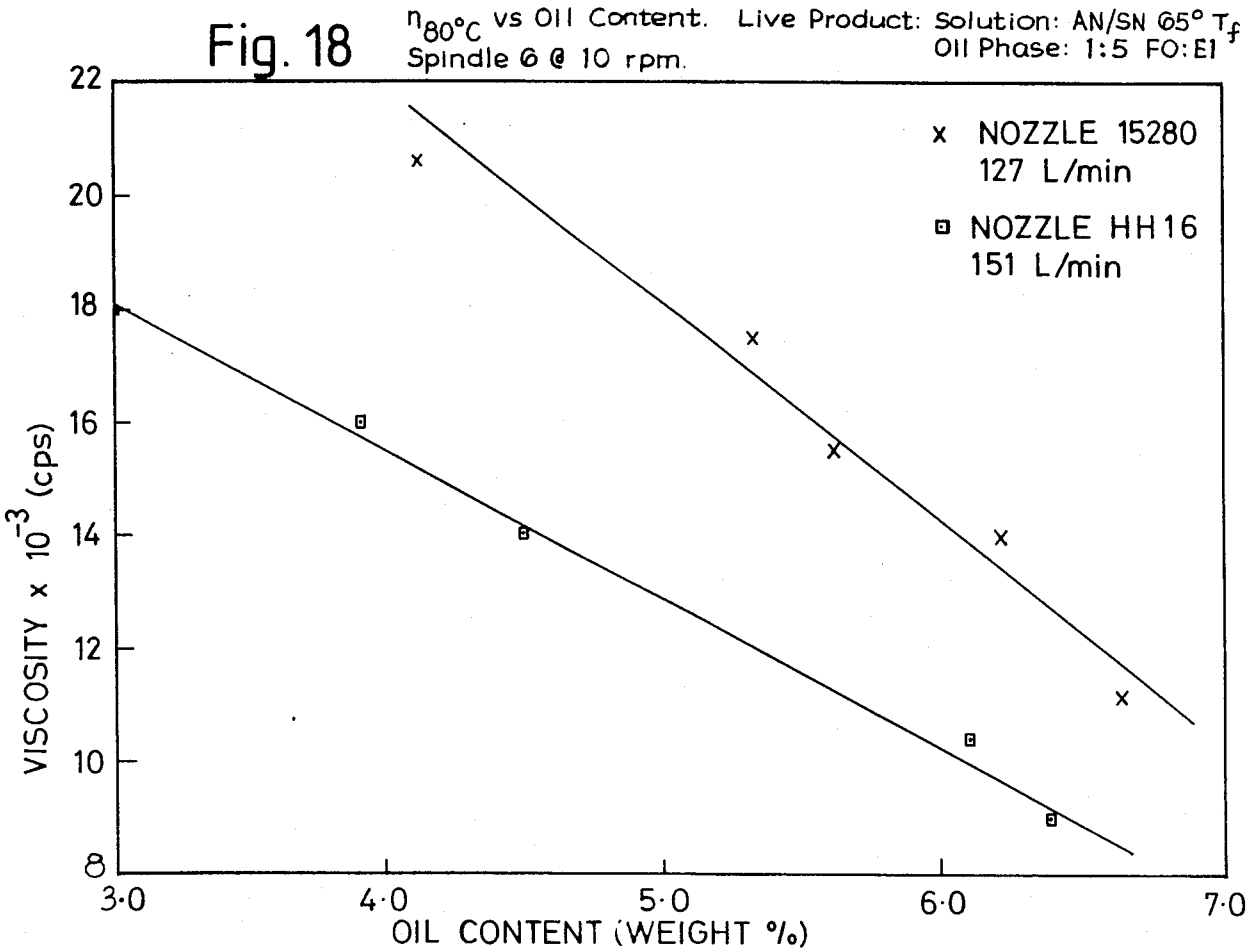
FIGS. 18 to 21 show the variations in viscosity profiles between SMO (sorbitan monooleate) and E1 (product of monoethanolamine and polyisobutenyl succinic anhydride) based products made using different nozzles (as shown on each graph)
Figure 19:
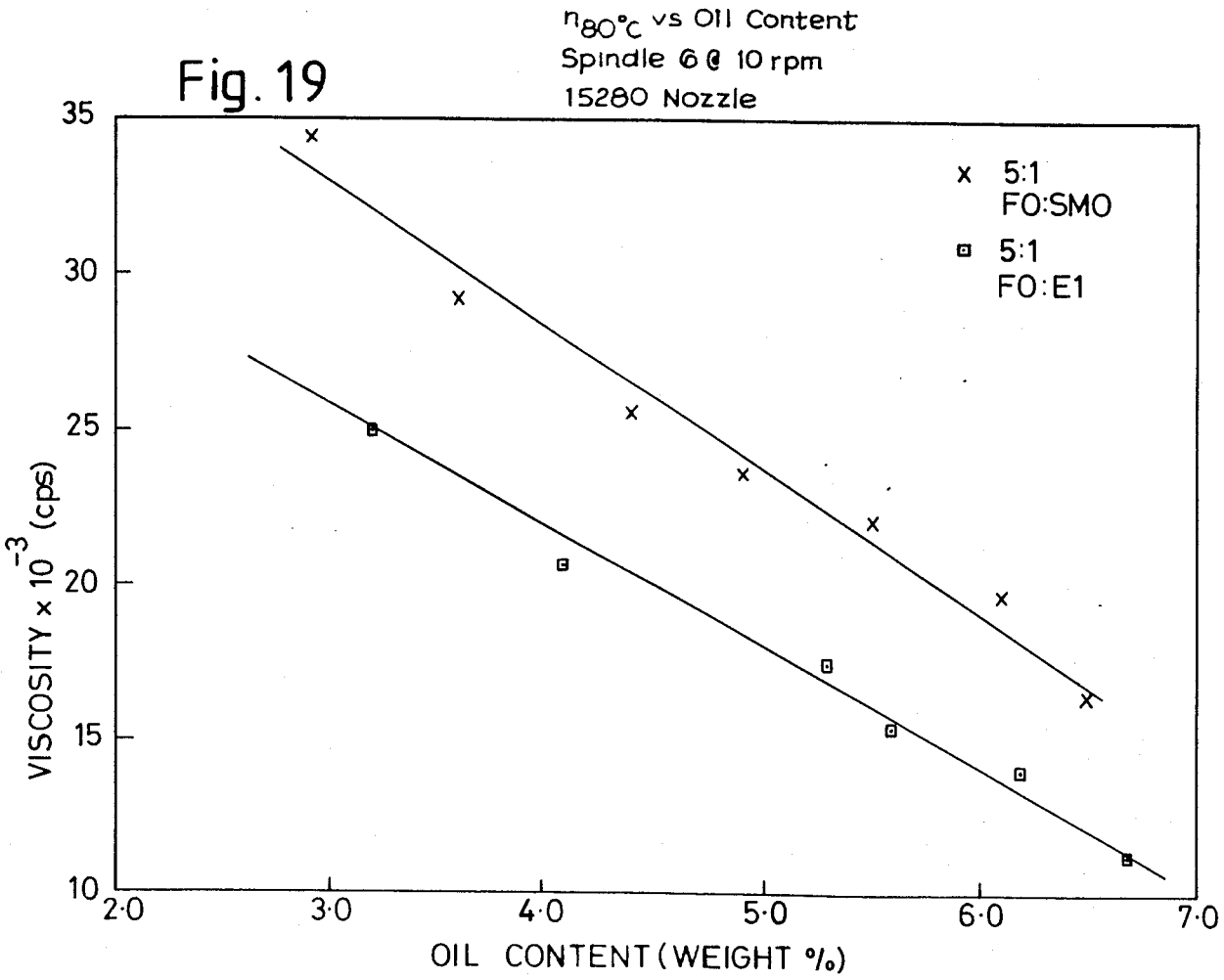
Figure 20:
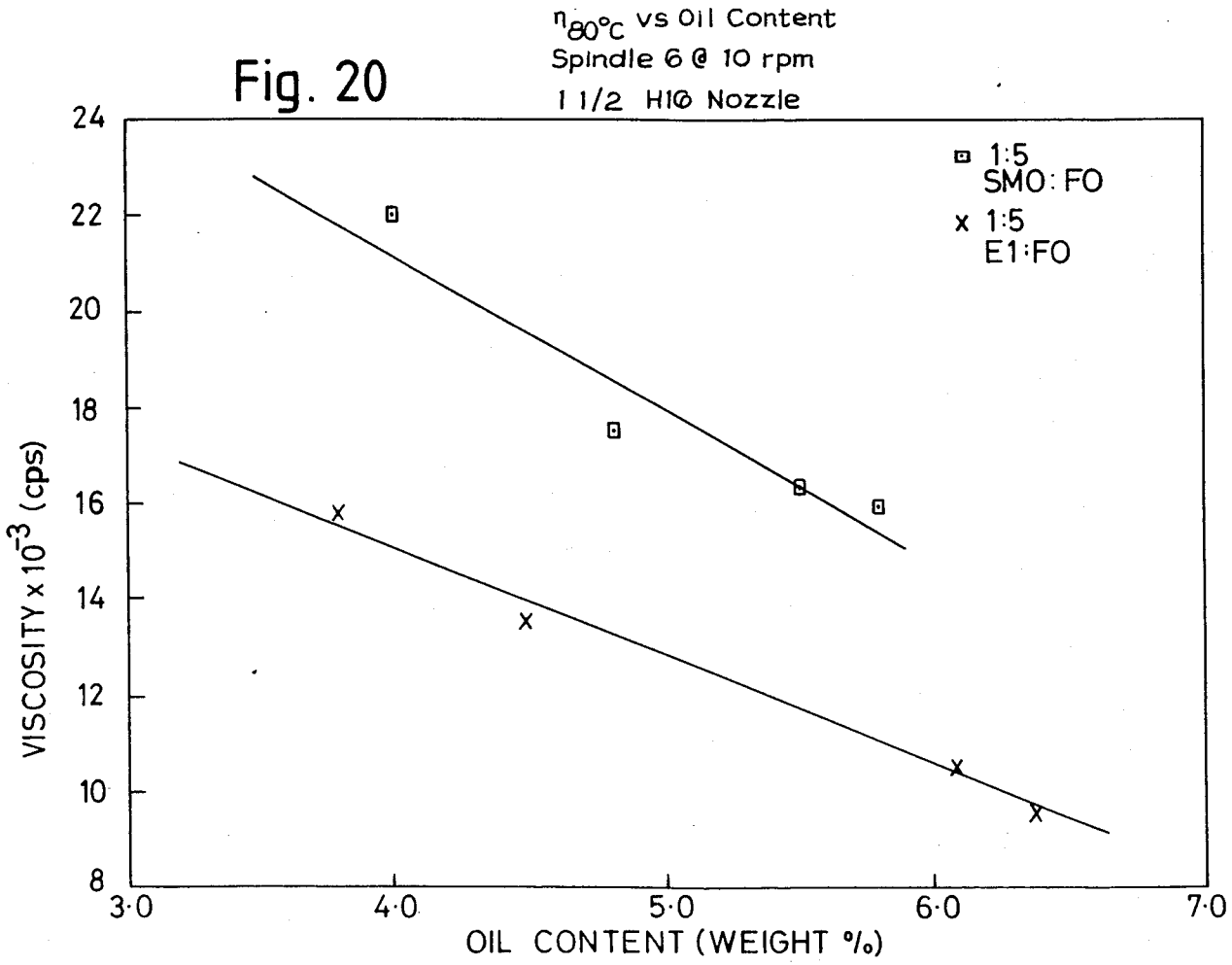
Figure 21:
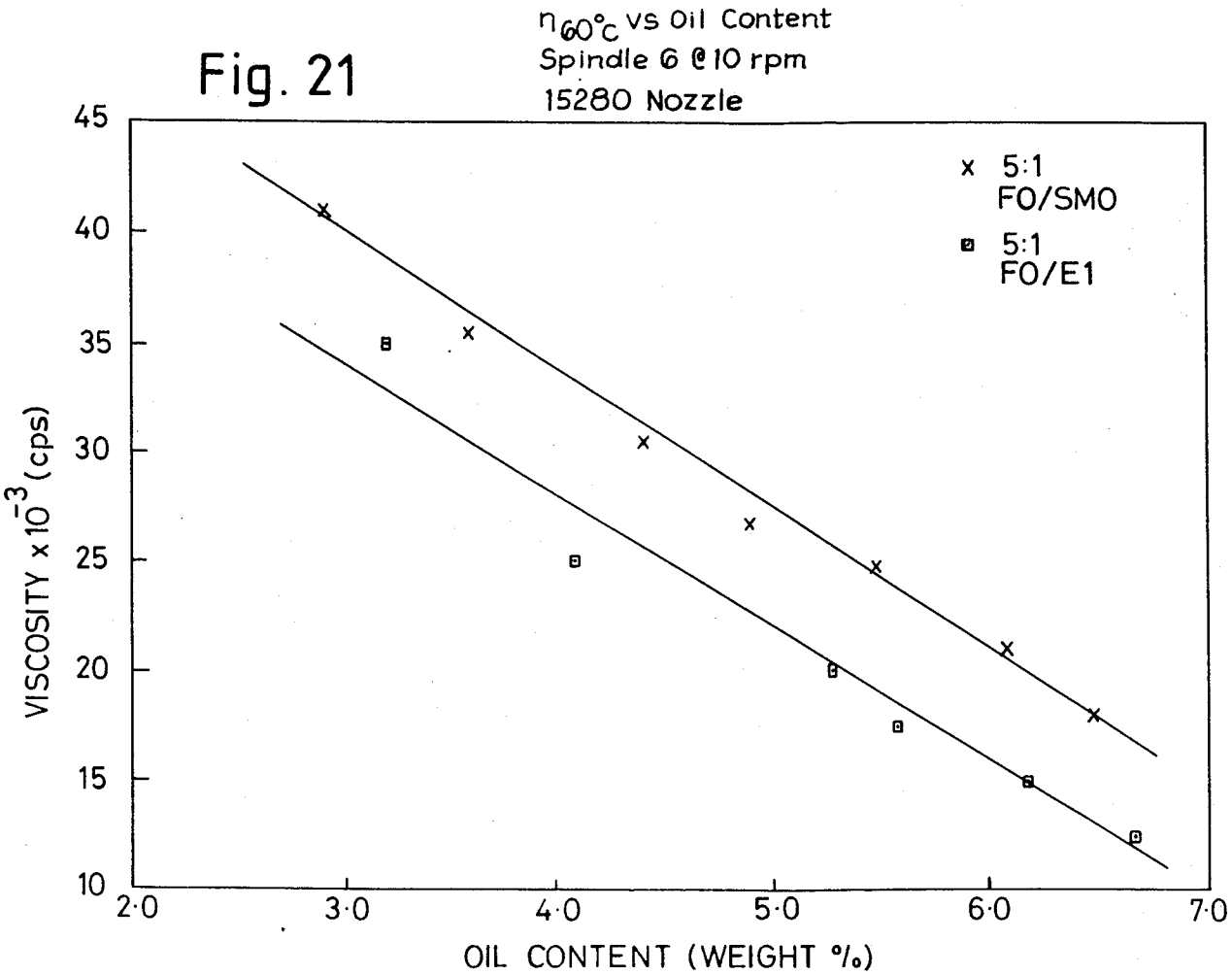
Figure 22:
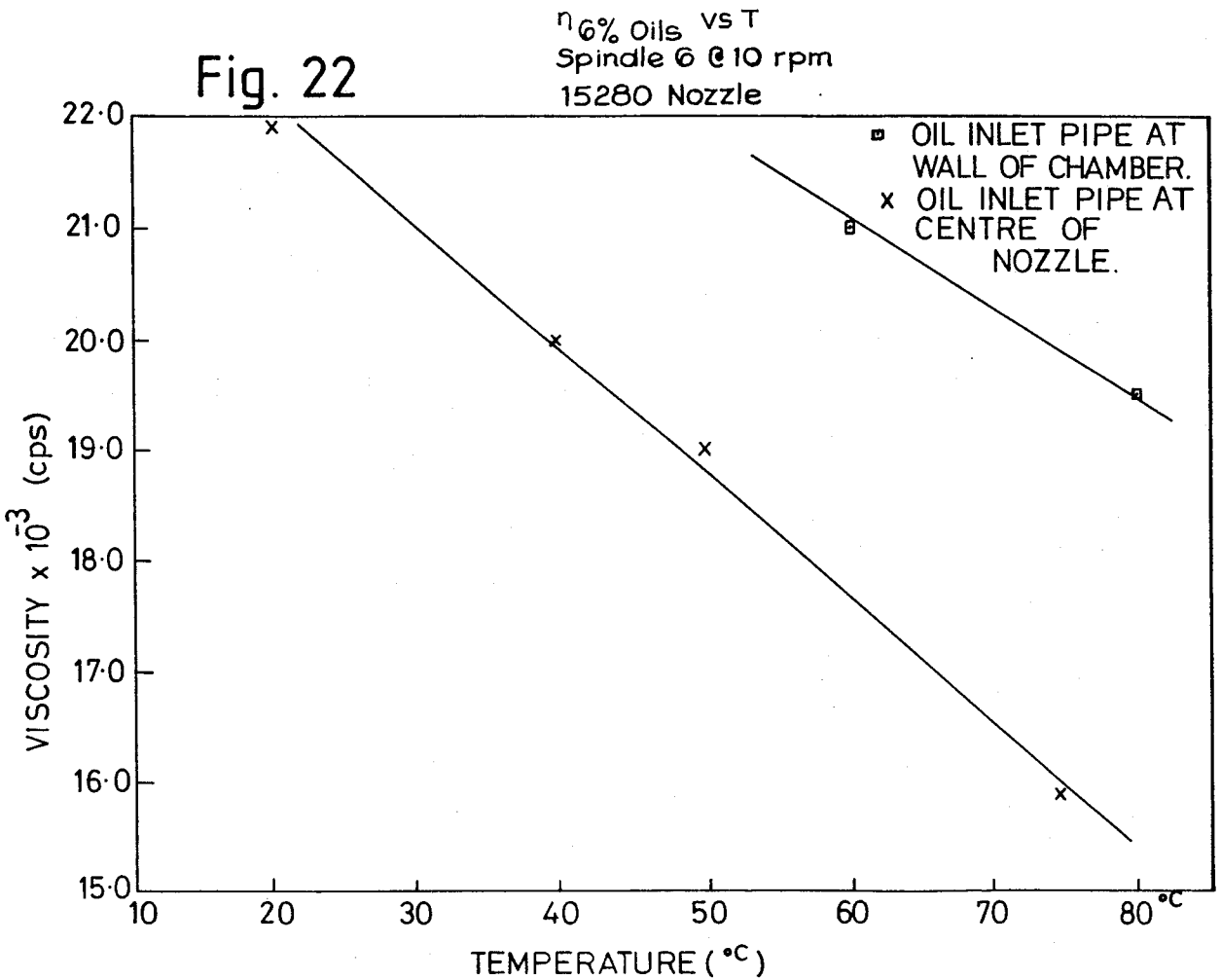
FIGS. 22 to 26 are graphs which indicate the effect on product viscosity of moving the oil inlet pipe from the central position shown in FIG. 1.
Figure 23:
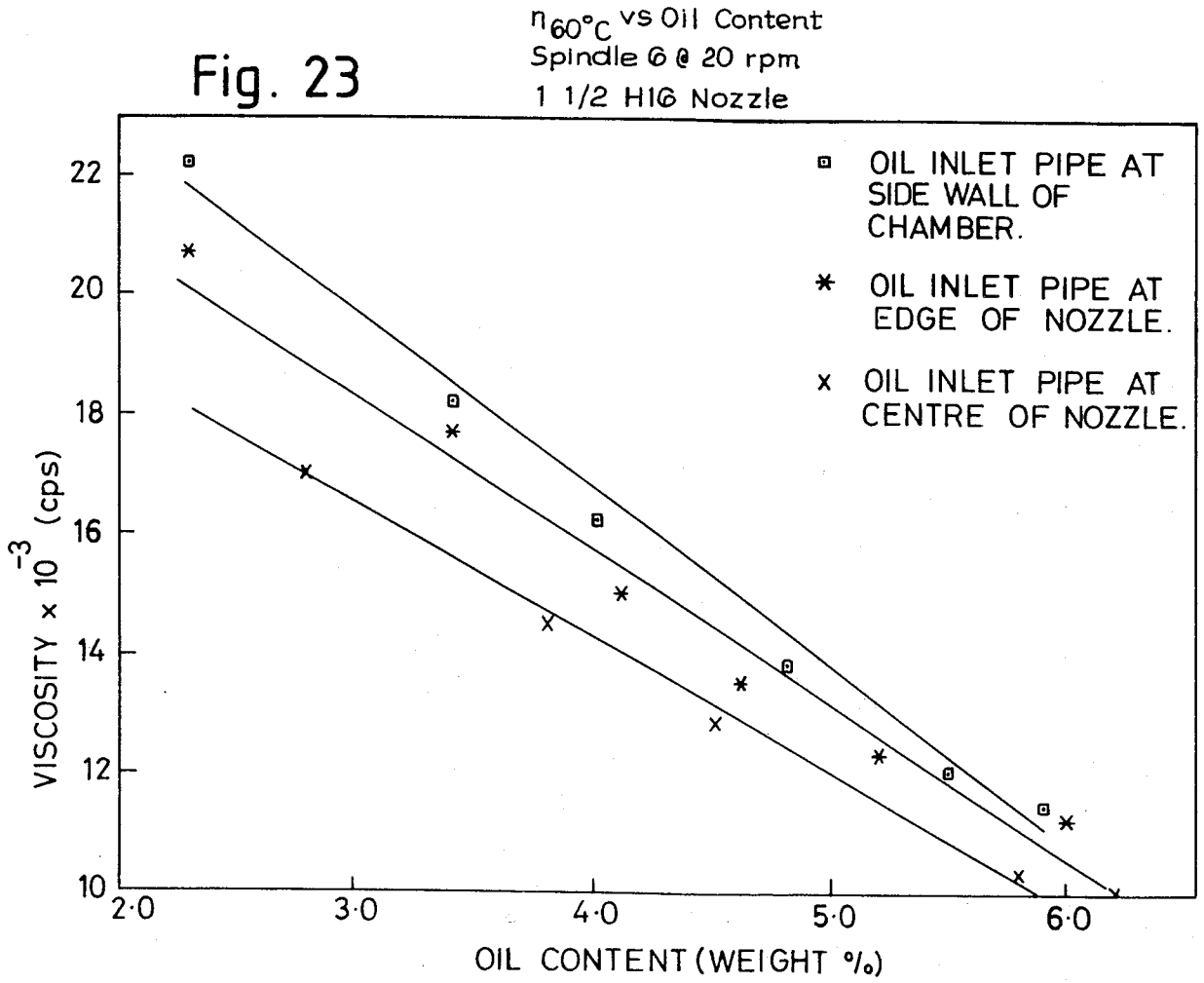
Figure 24:
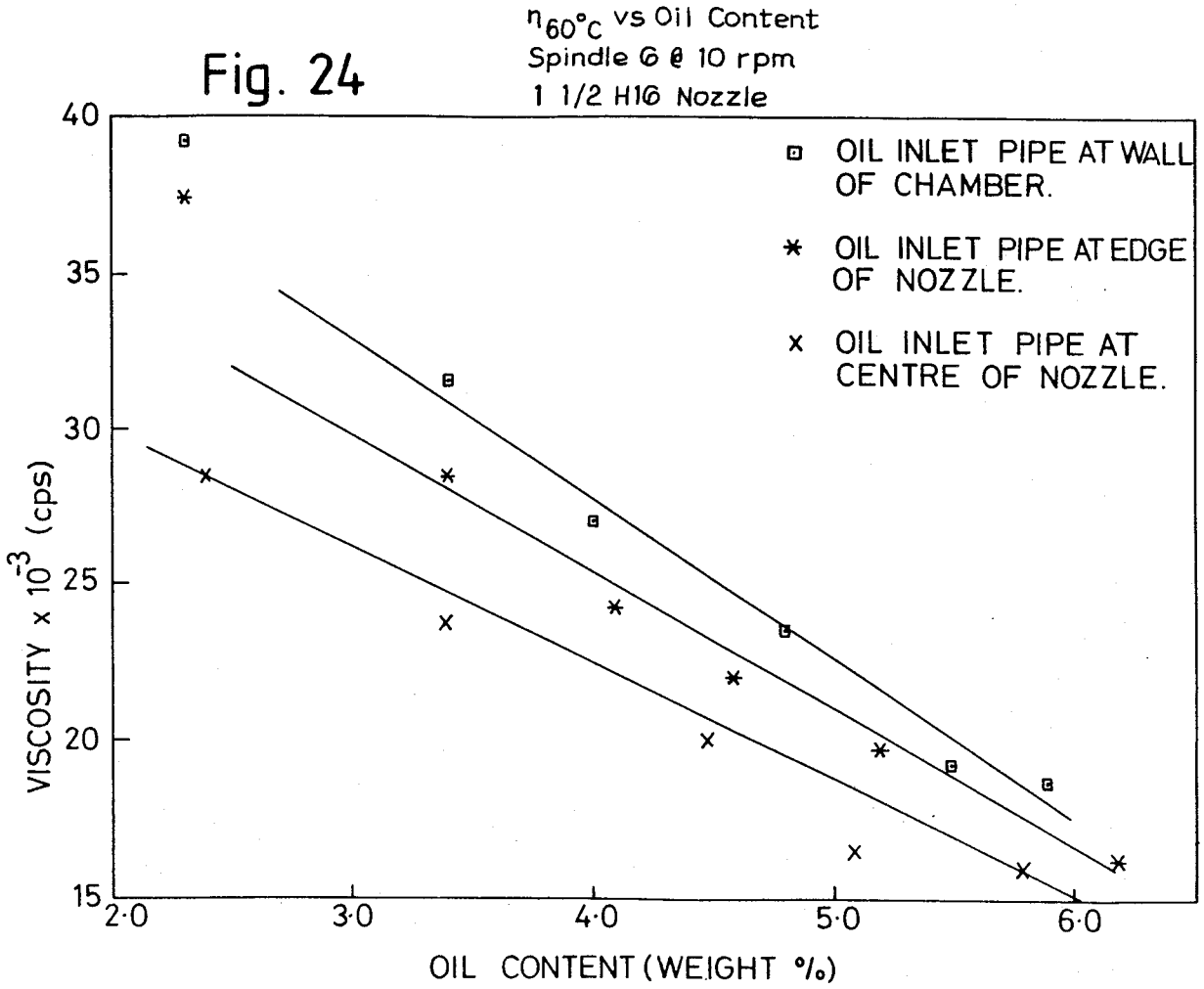
Figure 25:
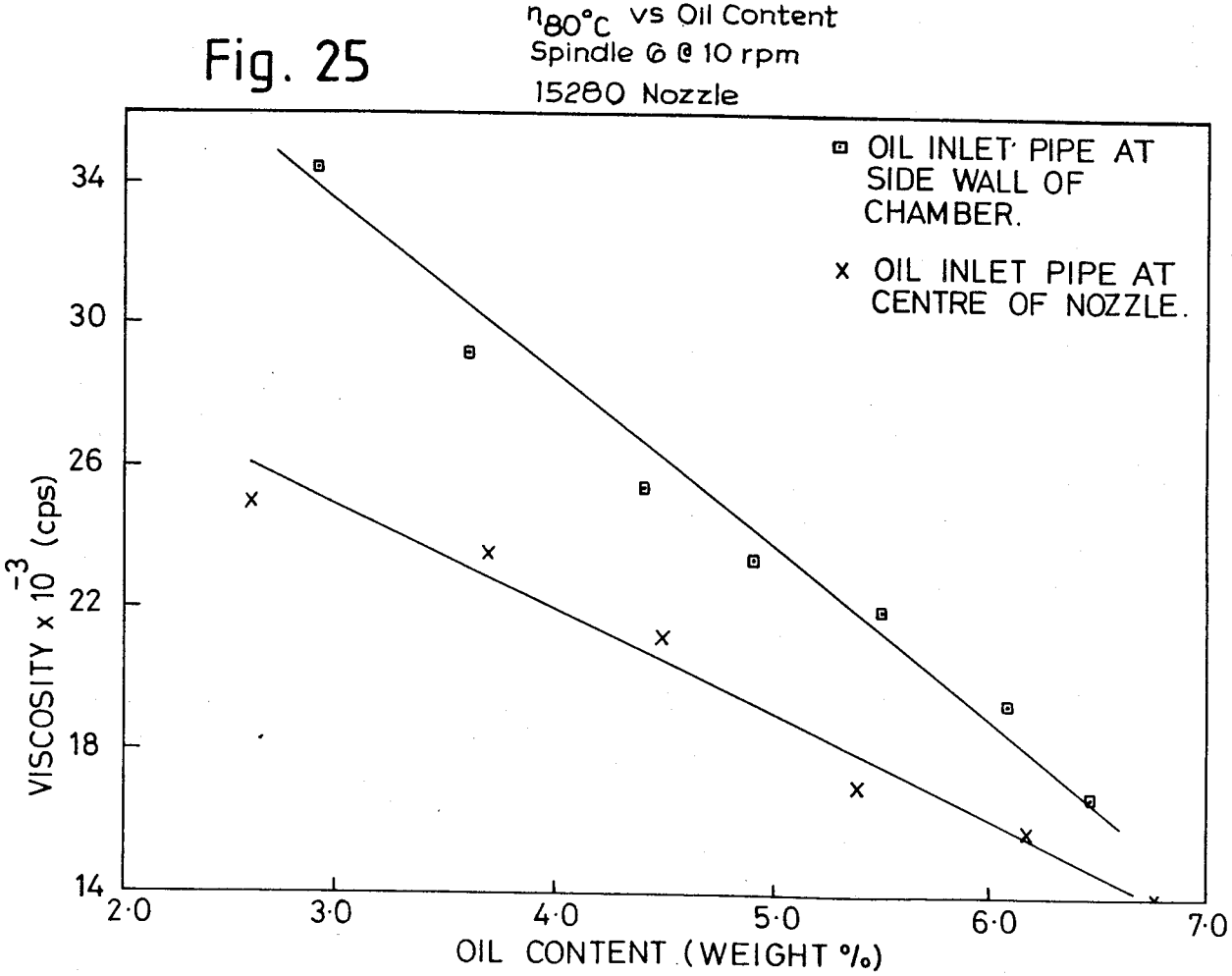
Figure 26:
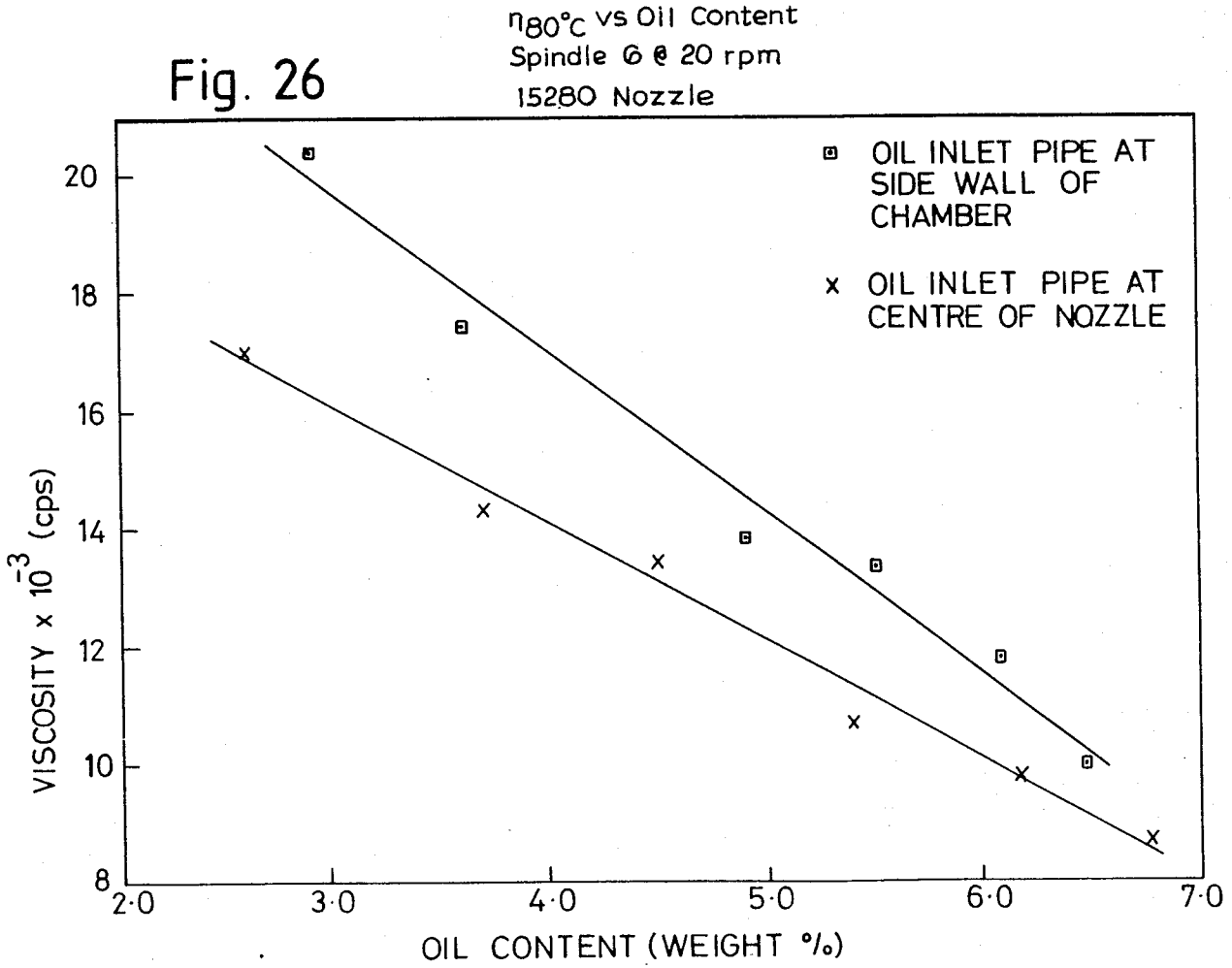

The effect of the nature of the oil phase on process capability is shown in FIGS. 9 and 10. In general, minimum oil contents were lower for fuel oil based products than paraffin oil based products. All product types could be made at oil phase contents of ≦5% (by weight).

Figure 27:
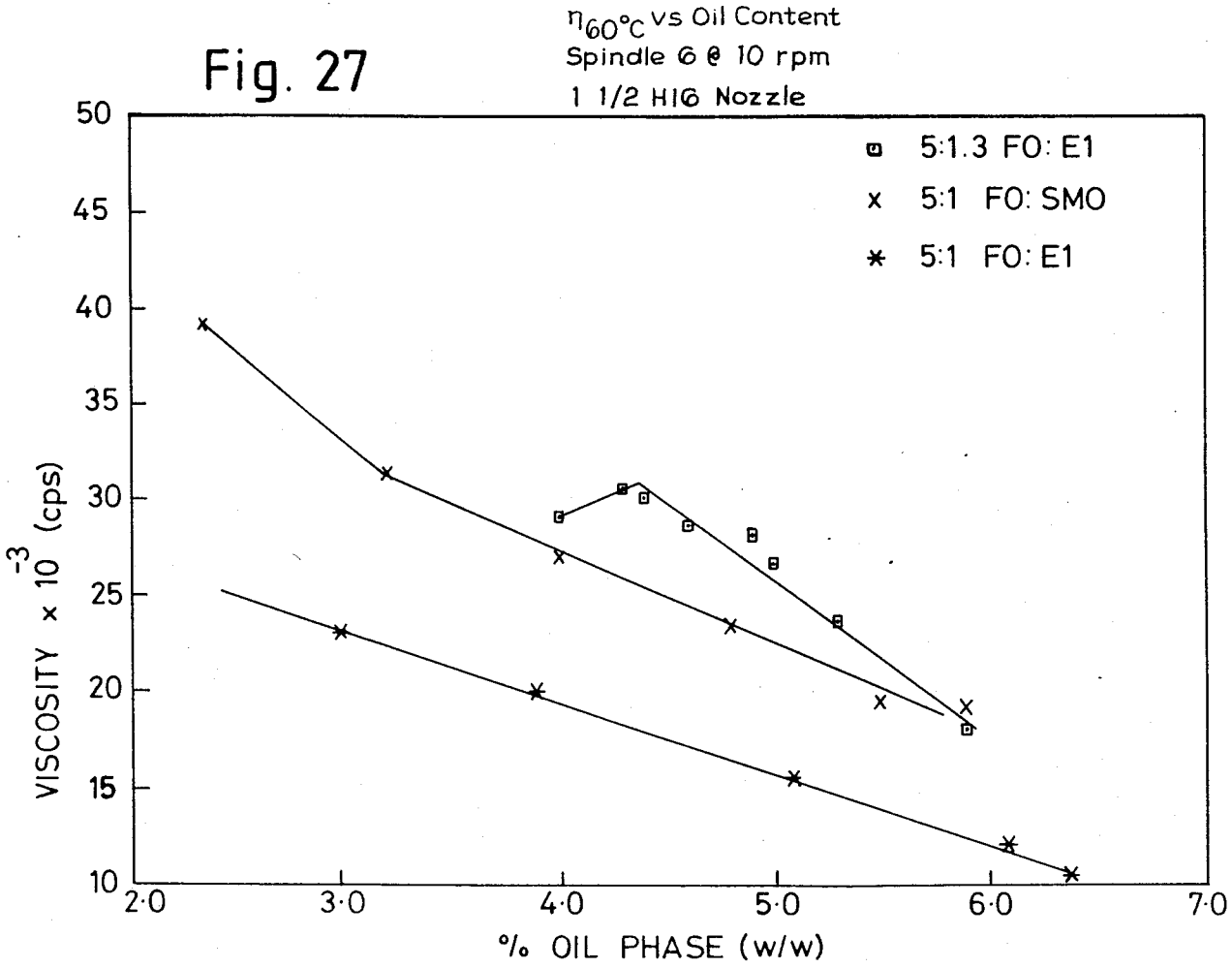
FIGS. 27 and 28 are graphs which show the effect of increased emulsifier (E1 or SMO) on product viscosity when using fuel oil as a basis for the continuous phase.
Figure 28:
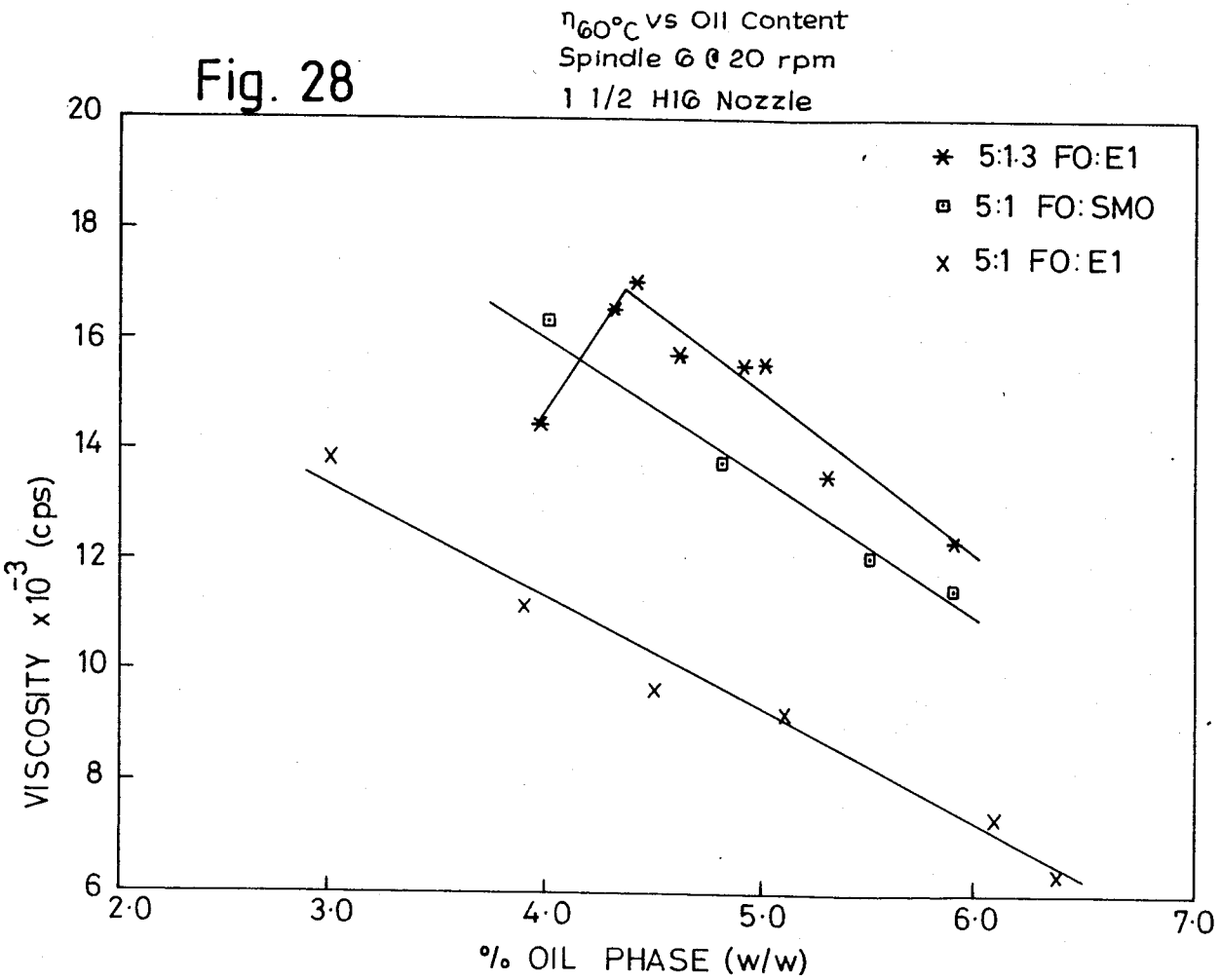

The effect of increased E1 (emulsifier) concentration on product viscosity is apparent from FIGS. 27 and 28 whereby a comparison with SMO may be made. The ratio of E1 to fuel oil was changed to 1.3:5 in accordance with estimated surface area per molecule determinations. A significant increase in viscosity was apparent to the extent that slightly higher values than those obtained for SMO were recorded. Droplet sizes of the emulsion made with 1:5 SMO:fuel oil and 1.3:5 E1:fuel oil were roughly equivalent.

EXAMPLE 1

Figure 1:
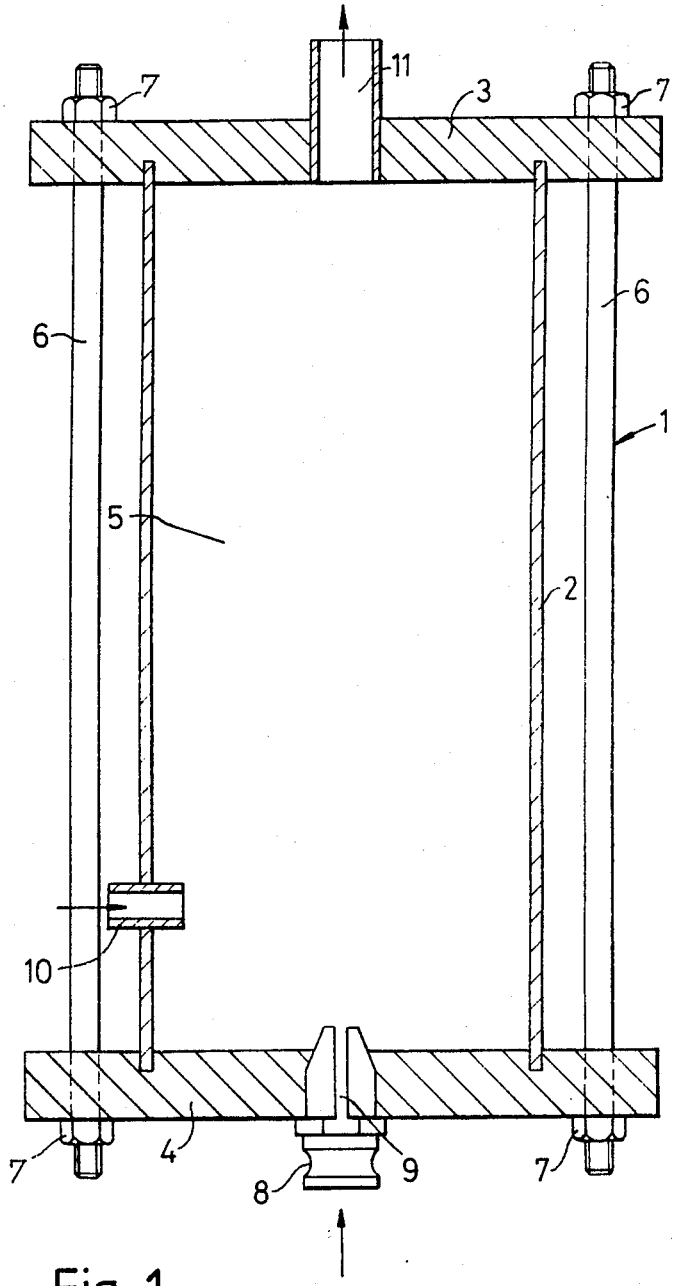
FIG. 1 is a cross-sectional view of an embodiment of the emulsification apparatus of the invention.

An oxidiser solution premix comprising 73% AN, 14.6% SN and 12.5% $H_2O$ was prepared by mixing the ingredients at 90° C. An oil phase comprising 16.7% sorbitan monooleate, 33.3% microcrystalline wax, 33.3% paraffin wax and 16.7% Paraffin oil was prepared by mixing the ingredients at 85° C. The oil phase premix was continuously pumped into a 4 inch (100 mm) diameter cylindrical mixing chamber (e.g. as shown in FIG. 1) at a rate of 2.3 liters per minute. After 15 seconds the oxidiser solution was pumped at a continuous flow rate of 20 liters per minute through a ½ inch (13 mm) H25 nozzle (available commercially from Spray Systems Inc.) at a pressure of 75 psi ($5.17\times10^5$ Pa) into the mixing chamber. The linear fluid velocity of the solution was 20 $ms^{-1}$ and the respective ratio of oxidiser solution to oil phase was 94:6 by weight. Emulsification took place instantaneously, the resultant emulsion having an average droplet size of 3 μm and a maximum droplet size of 12 μm.

EXAMPLES 2-7

An oxidiser solution premix comprising 67% AN, 17% SN and 16% $H_2O$ was prepared by mixing the ingredients at 80° C. An oil phase premix comprising 16.7% sorbitan monooleate and 83.3% paraffin oil was prepared at 30° C. The method of Example 1 was followed and satisfactory emulsification was achieved in a 6 inch (153 mm) diameter cylindrical mixing chamber under the conditions listed in Table II below.

TABLE II

| Example Number | 2 | 3 | 4 | 5 | 6 | 7 |
|---|---|---|---|---|---|---|
| Solution Flow Rate $l.min^{-1}$ | 20 | 38 | 110 | 127 | 134 | 153 |
| Nozzle Type | H25 | H4 | H16 | H16 | H16 | H16 |
| (inlet diameter) inches* | 0.5 | 0.75 | 1.5 | 1.5 | 1.5 | 1.5 |
| (mm) | (13) | (19) | (38) | (38) | (38) | (38) |
| (orifice diameter) inches* | 0.2 | 0.3 | 0.5 | 0.5 | 0.5 | 0.5 |
| (mm) | (4.6) | (6.4) | (12.7) | (12.7) | (12.7) | (12.7) |
| Cone Angle | 61-67° | 63-70° | 67-74° | 67-74° | 67-74° | 67-74° |
| Solution Linear Velocity $m.s^{-1}$ | 20 | 20 | 14.4 | 16.5 | 17.5 | 20 |
| Nozzle Pressure psi | 75 | 75 | 30 | 50 | 65 | 75 |
| ($\times 10^5$ Pa) | (5.2) | (5.2) | (2.1) | (3.4) | (4.5) | (5.2) |
| Minimum Oil Cont. % (m/m) | 2.9 | 3.4 | 4.7 | 4.7 | 4.7 | 4.7 |
| Average Droplet size at 6% Oil Phase μm | 3 | 3 | 12 | 9 | 7 | 5 |

*approximate sizes

The minimum oil content refers to that emulsion oil content below which emulsification was not effected.

EXAMPLES 8 TO 10

Using the same oxidiser solution premix and oil phase premix as for Examples 2 to 6, emulsification was effected in a 2 inch diameter mixing chamber following the method of Example 1 and utilising a 0.5 inch (13 mm) inlet diameter, 0.2 inch (4.6 mm) discharge orifice diameter nozzle (type H25) under the conditions in Table III below

TABLE III

| Example Number | 8 | 9 | 10 |
|---|---|---|---|
| Solution Flow Rate $l.min^{-1}$ | 7 | 15 | 20 |
| Solution Linear Velocity $m.s^{-1}$ | 7 | 15 | 20 |
| Nozzle Pressure psi | 35 | 45 | 75 |
| ($\times 10^5$ Pa) | (2.4) | (3.1) | (5.2) |
| Minimum Oil Cont. % (m/m) | 4.8 | 4.8 | 4.8 |
| Average | 12 | 6 | 4 |

TABLE III-continued

| Example Number | 8 | 9 | 10 |
|---|---|---|---|
| Droplet size at 4.8% Oil Phase μm | | | |

Table IV below presents further examples using two different formulations at higher nozzle back pressures (up to 100 psi), with total throughputs of up to 248 $kg.min^{-1}$, higher linear fluid velocities (up to 30 $m.s^{-1}$) and indicating typical viscosities of the products obtained under the various conditions stated. All viscosities measured by Brookfield viscometer as indicated.

7% fuel phase - phase volume ratio of 93 solution: 7 oil phase by mass

Composition A: AN/$H_2O$ 62°$_f$(AN:$H_2O$, 81:19) Diesel/E2 (50% active)/Arlacel C (3.3:1.4:0.7)

E2 (diethanolamine/PIBSA) as 50% active in diesel

Arlacel C=sorbitan oleate

Composition B: AN/$H_2O$ 62°$_f$(AN:$H_2O$, 81:19) Isopar/E2 (50% active)/Arlacel C (3.3:1.4:0.7)

Isopar is a light paraffin oil

TABLE IV

| Composition | A | A | A | A | B | B | B |
|---|---|---|---|---|---|---|---|
| Nozzle type | HH16 | H10 | H10 | H10 | HH16 | HH16 | HH16 |
| Vel. $m.s^{-1}$ | 22 | 30 | 27.6 | 25 | 20 | 17.5 | 25 |
| $Q_{soln}$ $l.min^{-1}$ | 169 | 130 | 120 | 110 | 152 | 134 | 108 |
| $Q_{oils}$ $l.min^{-1}$ | 20.4 | 15.9 | 14.8 | 13.5 | 19.13 | 16.5 | 14.0 |
| $P_{soln.}$ psi | 85 | 100 | 95 | 95 | 70 | 50 | 30 |
| % Oils | 6.7 | 6.8 | 6.9 | 6.8 | 7.1 | 6.9 | 7.2 |
| Total T.put $kg.min^{-1}$ | 248 | 191 | 176 | 162 | 222 | 195 | 158 |
| Brookfield Viscosities | | | | | | | |
| 80° C. | | | | | | | |
| 6 @ 10 rpm | 18500 | 26200 | 25400 | 22000 | 18300 | 11600 | 9000 |
| 7 @ 50 rpm | 6400 | 9360 | 8800 | 7600 | 6000 | 4800 | 3040 |
| 60° C. | | | | | | | |
| 6 @ 10 rpm | 23500 | 32000 | 30500 | 27500 | 18500 | 14200 | 9500 |
| 7 @ 50 rpm | 8000 | 12400 | 11400 | 11300 | 7600 | 9200 | 4000 |

In FIG. 1, an emulsification apparatus, generally designated 1, is shown which consists of a cylindrical tube 2, upper end closure 3 and lower end closure 4. When assembled as shown, tube 2 and closures 3 and 4 define a chamber 5. The assembly can be held together, for example, by bolts 6 secured by threaded nuts 7. Centrally located in lower end closure 4 is an atomizing nozzle 8 having a narrow passage 9 therein. Mounted in the side wall of chamber 5 and passing through tube 2 is an inlet tube 10. This inlet tube is adjustable both laterally (i.e. at right angles to the longitudinal axis of the tube 2) and longitudinally (i.e. along the length of the tube 2). Located in upper end closure 3 is an exit or outlet port 11.

Emulsification apparatus 1 is adapted to deliver a turbulent spray or stream of droplets of a discontinuous phase component into a body of a continuous phase component with sufficient velocity to effect emulsification. The continuous phase component is continuously introduced into chamber 5 through inlet tube 10 where it is entrained by a high velocity atomized stream or spray of the discontinuous phase component introduced continuously into chamber 5 through passage 9 in nozzle 8. The intermixing of the two phases forms an emulsion which may comprise particles of a size as small as 2 microns or less.

To achieve optimum emulsification of the two component phases which comprise the emulsion, several variable factors may be adjusted by trial and error to produce the desired end product. The diameter of chamber 5, the velocity of the atomized stream passing into chamber 5 through nozzle passage 9, the type or angle of spray achieved by nozzle 8, and the location of inlet tube 10 may all be manipulated to produce a desired end product in which the number average droplet size is about 2 μm.

Generally, these factors will be determined by experimentation and will be directly related to types of material employed in each of the phases. Use of a less viscous continuous phase, for example, may dictate parameters which are different from those when a heavier or more viscous phase is employed.

The material of construction of the apparatus is, preferably, of a corrosion resistant metal, such as, stainless steel although rigid plastic material, such as PVC, may be employed. While the end closures 3 and 4 may be permanently fixed to the cylindrical tube 2, it is preferred that closures 3 and 4 be removable for cleaning and inspection of the inner chamber 5. Nozzle 8 is conveniently adapted for easy replacement e.g. having a threaded barrel for insertion in a corresponding tapped bore in the end closure 4 and having an opposite end portion adapted to receive a driving tool e.g. hexagonal flats arranged to receive a spanner or socket.

As is well known in the art, emulsification agents or "emulsifiers" will be included in one or the other of the phases in order to encourage droplet dispersion and to maintain the emulsion's physical stability. The choice of emulsifier will be dictated by the required end use or application and numerous choices will be familiar to those skilled in the art.

In the manufacture of a water-in-fuel emulsion explosive using the apparatus of the invention, the fuel component, for example, a heated mixture of 84% by weight of fuel oil and 16% by weight of a surfactant, such as sorbitan monooleate, is introduced into chamber 1 as a measured volume stream through inlet tube 10. When steady flow has been achieved, a heated, saturated or less than saturated aqueous salt solution of an oxidizer salt, such as ammonium nitrate is passed into chamber 1 as a high velocity atomized spray through nozzle 8. The rate of flow of each of the oil/surfactant phase and the aqueous salt solution phase is adjusted so that the ratio by weight of oil/surfactant phase to salt solution phase is from 3:97 to 8:92, which is a typical proportion or range of fuel-to-oxidizer in a water-in-fuel emulsion explosive. As the emulsified mixture is produced within chamber 5, its volume increases until an outlet flow occurs at outlet port 11.

Except under conditions of very close confinement and heavy boostering, the emulsified water-in-oil explosive which is delivered from chamber 5 through outlet 11 is insensitive to initiation and, hence, is generally not a commercially useful product. To convert the product to either a non-cap-sensitive blasting agent or to small diameter, cap-sensitive explosive, the emulsion delivered from chamber 5 must be further treated to provide for the inclusion therein of a sensitizer, for example, particulate void-containing material, such as glass or resin microballoons or by the dispersion throughout the explosive of discrete bubbles of air or other gas.

Figure 2:
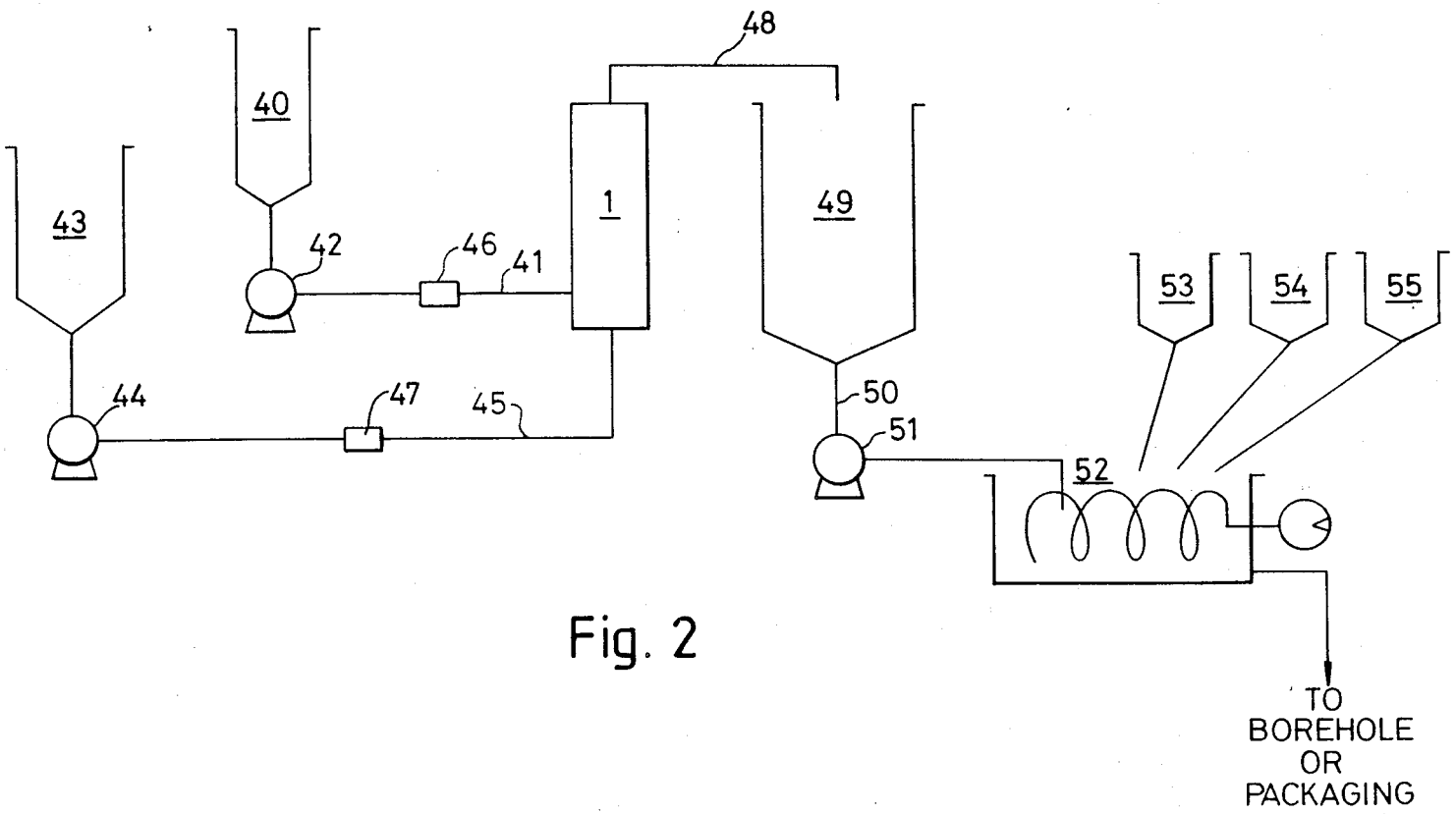
FIG. 2 is a flow diagram of a typical emulsion continuous preparation process employing the apparatus and method of the invention.
Figure 3:
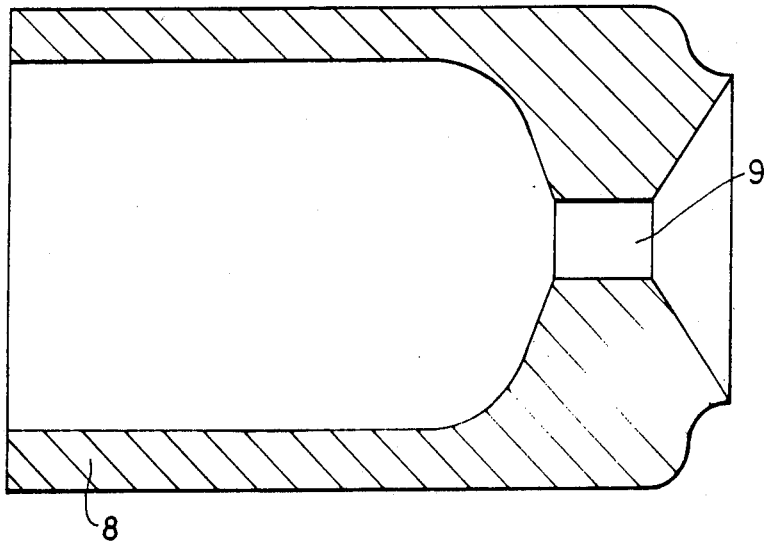
FIG. 3 is a section through a nozzle suitable for the purposes of this invention.

The method of preparation of a detonatable emulsion explosive composition utilizing the novel emulsification method and apparatus of the invention will now be described with reference to FIG. 2. The oil or fuel phase of the composition may comprise, for example, a variety of saturated or unsaturated hydrocarbons including petroleum oils, vegetable oils, mineral oils, dinitrotoluene or mixtures of these. Optionally, an amount of a wax may be incorporated in the fuel phase. Such a fuel phase is stored in a holding tank 40 which tank is often heated to maintain fluidity of the fuel phase. The fuel is introduced into the emulsification apparatus 1 through inlet conduit 41 by means of pump 42. An emulsifier, such as, for example, sorbitan mono-oleate, sorbitan sesqui-oleate or Alkaterge T (Reg TM) is proportionally added to the fuel phase in holding tank 40. The amount of emulsifier added generally comprises from about 0.4 to 4% by weight of the total composition. An aqueous solution of oxidizer salt containing 70% or more by weight of salts selected from ammonium nitrate, alkali and alkaline earth metal nitrates and perchlorates, amine nitrates or mixtures thereof, is delivered from a heated tank or reservoir 43 by means of pump 44 to emulsification apparatus 1 through conduit inlet 45. The aqueous phase is maintained in a supersaturated state. The rate of flow of the fuel phase and the aqueous phase can be adjusted by observation of flow indicators 46 and 47 so that the resultant mixture is in a desired high phase ratio typically, for example, 92–97% by weight of the aqueous phase to 3 to 8% by weight of the fuel phase. The continuously mixed and emulsified fuel component and salt solution component in emulsification apparatus 1 is forced through conduit 48 into holding tank 49. The emulsified mixture is withdrawn from tank 49 through conduit 50 by pump 51 and is then passed into blender 52 where the density of the final product is adjusted by the addition of, for example, microballoons or other void-containing material from source 53. Additional material, such as finely divided aluminum, may also be added to blender 52 from sources 54 and 55. From blender 52, the final product, which is a sensitive emulsion explosive, may be delivered to the borehole as a bulk explosive or to a packaging operation.

Figure 29:
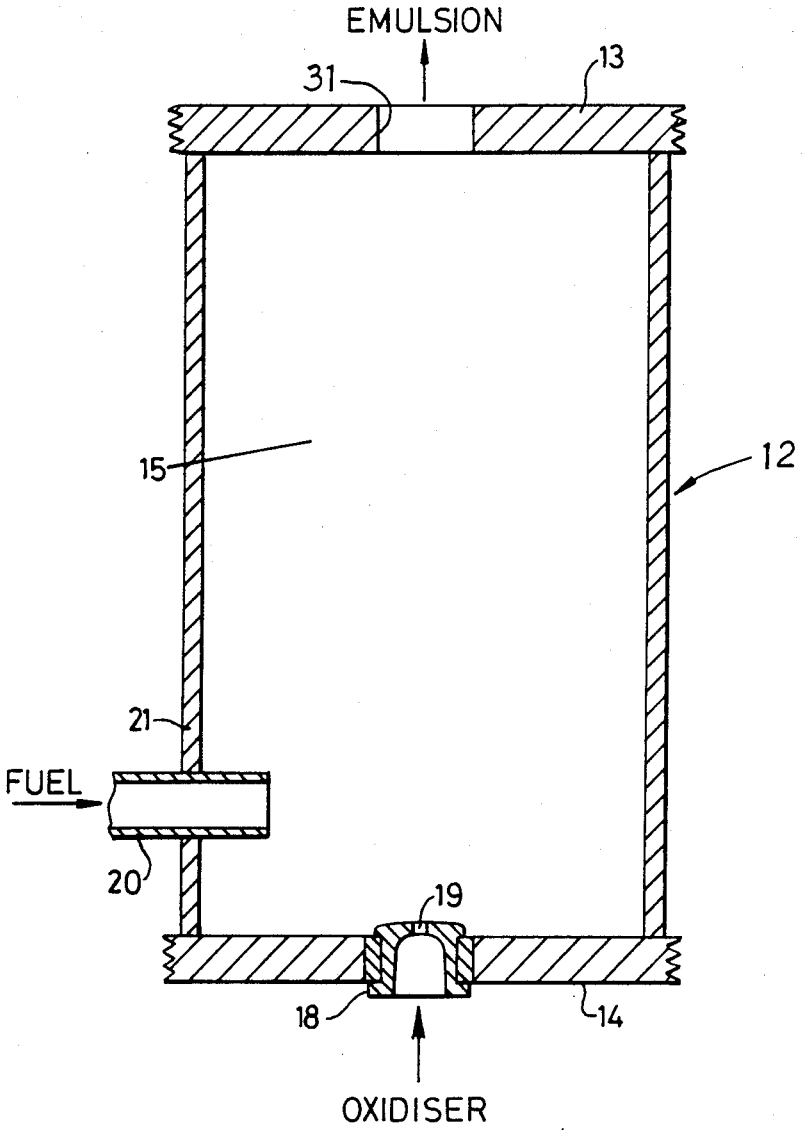
FIG. 29 shows a cross-sectional view of an improved emulsification apparatus according to this invention.

In a further embodiment of the invention as illustrated in FIG. 29, a modified emulsification apparatus comprises a 10" (254 mm) diameter cylindrical vessel 12 having removable end closures 13, 14 defining a closed chamber 15 which receives an immiscible oxidiser liquid at a rate of about 10 kg.min$^{-1}$ through an atomising nozzle 18 discharging into said chamber through a short path length narrow passage 19, and an organic fuel medium via an inlet tube 20 located in the sidewall 21 in a position providing for entrainment of fuel in the discharged stream of atomised oxidiser to form a stabilised emulsion which exits the said chamber under restricted flow conditions via a 2" (50 mm) outlet port 31.

In addition to use of a 2" outlet port in a 10" diameter chamber good results have been obtained with a ½" outlet in a 2" chamber. Work carried out using ⅜" (9.5 mm) and ¼" (6.4 mm) outlet ports with 2" diameter chambers has also proved equally satisfactory.

Formulations tested in this modified apparatus are similar to those previously described hereinbefore and generally comprise an aqueous discontinuous oxidiser phase such as AN/SN with an emulsifier such as sorbitan monooleate and an organic continuous fuel phase such as paraffin wax/paraffin oil.

A significant advantage of this invention is that the very rapid break-up or disintegration time means that droplet production is independent of external phase conditions.

We claim:

1. A method for the continuous production of an oil/water emulsion explosive composition which method comprises simultaneously and continuously introducing into a mixing chamber separate liquid streams of a continuous phase component and an immiscible discontinuous phase component, the said immiscible discontinuous phase component being introduced into the said continuous phase through turbulence inducing means which constricts the flow of said immiscible discontinuous phase such as to cause its disruption to form fine droplets of a desired size upon its emergence into the mixing chamber, said turbulence inducing means further causing said immiscible discontinuous phase to emerge in a flow pattern and at a flow rate sufficient to cause the droplets so formed to entrain a sufficient quantity of the continuous phase component to provide for mixing thereof with the droplets to achieve stabilisation of same in the continuous phase and thereby continuously form said emulsion.

2. The method of claim 1 wherein the means for causing disruption of the discontinuous phase comprises an orifice through which said discontinuous phase is caused to pass under pressure which is sufficient to cause droplet formation within about 0.5 mm of passing through said orifice.

3. The method of claim 2 wherein droplet formation occurs within about 0.2 mm of passing through said orifice.

4. The method of claim 1 wherein the means for causing disruption of the discontinuous phase comprises a nozzle which discharges into said mixing chamber and which is adapted to constrict flow sufficiently to cause turbulence in the stream of discontinuous phase to provide for discharge of dispersed single phase droplets of a size comparable to the eddies in the flow created within the nozzle in use under operating conditions.

5. The method of claim 4 wherein the nozzle has a divergent orifice.

6. The method of claim 5 wherein the nozzle has a cone angle of up to 70°.

7. The method of claim 5 wherein the nozzle has a cone angle of up to 30°.

8. The method of claim 5 wherein the nozzle has a cone angle of up to 15°.

9. The method of claim 1 wherein the means for causing disruption of said immiscible discontinuous phase stream into droplets further imparts a rotational element of motion to the flow pattern of said droplets to facilitate intermixing of said continuous phase with said droplets and formation of said emulsion.

10. The method of claim 9 wherein said rotational element of motion is imparted to said droplets by passing said discontinuous phase stream through baffles, helical passages or a passage tangential to an orifice for discharge of droplets formed from said stream into the mixing chamber.

11. The method of claim 1 wherein said means for disruption of said discontinuous phase stream provides for localised specific energy dissipation rates ($\epsilon$) in the range of from about $10^4$ to $10^8$ W/kg.

12. The method of claim 11 wherein said means for disruption of said discontinuous phase stream provides for specific energy dissipation rates ($\epsilon$) in the range of from about $10^6$ to $10^7$ W/kg.

13. The method of claim 1 wherein the mass flow of each of said continuous and discontinuous phase streams is adjustable to provide for ratios of continuous phase to discontinuous phase in the range of from about 3:97 to 8:92.

14. The method of claim 13 wherein the ratio of continuous phase to discontinuous phase is around 6:94.

15. The method of claim 1 wherein the linear fluid velocity of the immiscible discontinuous phase stream through said means for causing its disruption into droplets lies in the range of from about 5 to 40 $ms^{-1}$.

16. The method of claim 1 wherein the discontinuous phase component is introduced as an isotropic turbulent jet of Reynolds number of from about 30,000 to 500,000.

17. The method of claim 16 wherein the discontinuous phase component is introduced as an isotropic turbulent jet of Reynolds number greater than about 50,000.

18. The method of claim 3 wherein the operating pressure in the nozzle is in the range of from about 10 psi to 200 psi ($0.7\times10^5$ Pa to $13.8\times10^5$ Pa).

19. The method of claim 18 wherein the operating pressure in the nozzle is in the range of from about 30 psi to 135 psi ($2.1\times10^5$ to $9.3\times10^5$ Pa).

20. The method of claim 1 wherein the continuous phase is introduced via a pipe which intrudes into the mixing chamber a sufficient distance to provide for contact of the continuous phase with the discontinuous phase in the region of droplet formation but itself does not enter said region so as to avoid coalescence of droplets by contact or interference with the end of the pipe.

21. The method of claim 20 wherein the degree of intrusion of said pipe into the mixing chamber is adjustable.

22. The method of claim 1 wherein the emulsion formed in the mixing chamber is removed from the chamber via means including a constriction which restricts the flow of emulsion issuing from the chamber.

23. The method of claim 1 wherein a sensitising agent or additional fuel component is subsequently mixed with the emulsion.

24. The method of claim 1 wherein the continuous phase comprises an oil-rich phase containing at least one surfactant selected from the group consisting of a sorbitan ester, and the reaction product of an ethanolamine and polyisobutenyl succinic anhydride (PIBSA).

25. The method of claim 24 wherein the continuous phase contains a reaction product of an ethanolamine and polyisobutenyl succinic anhydride.

26. The method of claim 24 wherein the proportions of oil:sorbitan ester surfactant:PIBSA surfactant is about 4:0.7:0.7.

27. A method for the continuous production of an oil in water emulsion explosive composition comprising a non-shear turbulent mixing step wherein an emulsion forming the basis of the composition is formed directly from an oil phase and an aqueous phase.

28. A process for producing a multi-phase emulsion explosive comprising forming a turbulent jet of a discontinuous phase oxidiser component having a Reynolds number of greater than about 50,000 to produce droplets having a number average droplet size of about 1 to 10 $\mu$m diameter and contacting said jet continuously in the region of droplet formation with an organic fuel continuous phase medium in an amount which is sufficient to provide droplet stabilisation and sustain formation of the resulting emulsion.

* * * * *